US008109498B2

(12) United States Patent
Akimatsu

(10) Patent No.: US 8,109,498 B2
(45) Date of Patent: Feb. 7, 2012

(54) SHEET FEEDING DEVICE

(75) Inventor: Takayuki Akimatsu, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 12/852,005

(22) Filed: Aug. 6, 2010

(65) Prior Publication Data

US 2011/0074087 A1 Mar. 31, 2011

(30) Foreign Application Priority Data

Sep. 30, 2009 (JP) ..... 2009-225786

(51) Int. Cl.
*B65H 5/00* (2006.01)

(52) U.S. Cl. ..... 271/10.11; 271/10.01

(58) Field of Classification Search ..... 271/10.01, 271/10.11, 109, 118, 121, 3.18, 264
See application file for complete search history.

(56) References Cited

U.S. PATENT DOCUMENTS

| | | | | |
|---|---|---|---|---|
| 5,923,438 | A | 7/1999 | Fujiwara | |
| 6,547,235 | B2 * | 4/2003 | Higaki | 271/10.01 |
| RE38,212 | E * | 8/2003 | Westcott et al. | 271/10.03 |
| 7,320,462 | B2 * | 1/2008 | Takamatsu | 271/3.14 |
| 7,429,039 | B2 | 9/2008 | Hattori et al. | |
| 2002/0038932 | A1 * | 4/2002 | Kaiga et al. | 271/114 |
| 2002/0074711 | A1 * | 6/2002 | Higaki | 271/117 |
| 2003/0047862 | A1 * | 3/2003 | Komatsu | 271/10.01 |
| 2005/0087920 | A1 * | 4/2005 | Takamatsu | 271/10.01 |
| 2006/0085946 | A1 | 4/2006 | Hattori et al. | |
| 2009/0166962 | A1 * | 7/2009 | Osakabe et al. | 271/264 |
| 2011/0148034 | A1 * | 6/2011 | Inoue | 271/264 |

FOREIGN PATENT DOCUMENTS

| | | | |
|---|---|---|---|
| JP | 61-65042 | U | 5/1986 |
| JP | 5-072824 | | 3/1993 |
| JP | 8-340418 | A | 12/1996 |
| JP | 10-59575 | A | 3/1998 |
| JP | 10-207139 | A | 8/1998 |
| JP | 2000-233849 | | 8/2000 |
| JP | 2005-123918 | A | 5/2005 |
| JP | 2006-118613 | A | 5/2006 |

OTHER PUBLICATIONS

JP Office Action dtd Oct. 25, 2011, JP Appln. 2009-225786, English translation.

* cited by examiner

*Primary Examiner* — Kaitlin Joerger
(74) *Attorney, Agent, or Firm* — Banner & Witcoff, Ltd.

(57) ABSTRACT

A sheet feeding device, having a sheet feeding mechanism and an image processor is provided. The sheet feeding mechanism includes a base structure, a first roller, and a second roller. The first roller includes a first shaft and a first roller body fixed to the first shaft. The second roller includes a second shaft and a second roller body fixed to the second shaft. The first roller feeds a sheet into a sheet feeding path, and the second roller conveys the sheet in the sheet feeding path. The first roller and the second roller are connected with each other by a connector member, which rotatably supports the first shaft and the second shaft and maintains positional relation of the first shaft and the second shaft with respect to each other.

16 Claims, 17 Drawing Sheets

SHEET FEEDING DEVICE

CROSS REFERENCE TO RELATED APPLICATION

This application claims priority from Japanese Patent Application No. 2009-225786, filed on Sep. 30, 2009, the entire subject matter of which is incorporated herein by reference.

BACKGROUND

1. Technical Field

An aspect of the present invention relates to a sheet feeding device to convey a sheet in a sheet feeding path.

2. Related Art

A sheet feeding device to be provided to, for example, an image forming apparatus such as a printer and a copier, having a base structure, one or more pairs of conveyer rollers arranged in positions along a feeding path, is known.

In the sheet feeding device, each of the conveyer rollers has a core shaft to be rotatably supported by the base structure and rollers which are fixed to the core shaft to be rotated along with the core shaft. The pair of conveyer rollers are thus rotated with the sheet in-between them so that the sheet is conveyed in the feeding path by the rotating force of the rollers. The sheet conveyed in the feeding path is led to an image forming unit of the image forming apparatus to have an image formed thereon.

When the conveyer rollers are rotated in the image forming apparatus by external driving force, the core shafts of the conveyer rollers may be subject to pressure of the driving force, and the conveyer rollers may be bowed by the pressure. When the conveyer rollers are bowed, the sheet may be conveyed in a skewed orientation with respect to the feeding path and may cause sheet feeding errors such as sheet jam. The error condition in the sheet may prevent the image forming unit from correctly forming the image on the sheet. Therefore, in order to restrict the deformation of the conveyer rollers, the feeding device may be provided with arm-pieces extending in a direction perpendicular to the core shafts and hooked to the core shafts at one end and fixed to the base structure at the other end so that the arm-pieces suppress the core shafts.

SUMMARY

Such an arm-piece is required for each conveyer roller and increases a quantity of pieces of components in the sheet feeding device. Moreover, if the sheet feeding device is equipped with a plurality of pairs of conveyer rollers, and each conveyer roller requires the arm-piece, the quantity of pieces of components in the sheet feeding device increases to be even larger.

In view of the above drawback, the present invention is advantageous in that a sheet feeding device, in which sheet feeding errors in the feeding path can be reduced in a less complicated configuration, is provided.

According to an aspect of the present invention, a sheet feeding device, having a sheet feeding mechanism to convey a sheet in a sheet feeding path, and an image processor to process an image formed on one of a first surface and a second surface of the sheet being conveyed in the sheet feeding path, is provided. The sheet feeding mechanism includes a base structure, a first roller arranged in a position along the feeding path, and a second roller arranged in a position along the feeding path on a downstream side with respect to the first roller. The first roller includes a first shaft, which is rotatably supported by the base structure at each axial end thereof, and a first roller body fixed to the first shaft. The second roller includes a second shaft, which is rotatably supported by the base structure at each axial end thereof, and a second roller body fixed to the second shaft. The first roller feeds the sheet to the sheet feeding path by rotating the first roller body being in contact with the sheet rotated along with the first shaft, and the second roller conveys the sheet in the sheet feeding path by rotating the second roller body being in contact with the sheet rotated along with the second shaft. The first roller and the second roller are connected with each other by a connector member, which rotatably supports the first shaft and the second shaft and maintains positional relation of the first shaft and the second shaft with respect to each other.

BRIEF DESCRIPTION OF THE ACCOMPANYING DRAWINGS

DETAILED DESCRIPTION

Hereinafter, an embodiment according to the present invention will be described with reference to the accompanying drawings.

An automatic document feeder (ADF) 11 of an image processing apparatus 10 represents a sheet feeding device according to an embodiment of the present invention. In the present embodiment, directions concerning the image processing apparatus 10 will be referred to in accordance with the orientation of the image processing apparatus 10 shown in FIG. 1. That is, a nearer side in FIG. 1, on which an operation panel 3 is arranged, is referred to as front, and further side opposite from the operation panel 3 is referred to as rear. Further, a side which corresponds to a viewer's left-hand side is referred to as left, and an opposite side from the left is referred to as right. Furthermore, directions of the drawings in FIGS. 2-20 are similarly based on the orientation of the image processing apparatus 10 as defined above and correspond to those with respect to the image processing apparatus 10 shown in FIG. 1 even when the drawings are viewed from different aspects.

1. Overall Configuration of the Image Processing Apparatus

Figure 1:
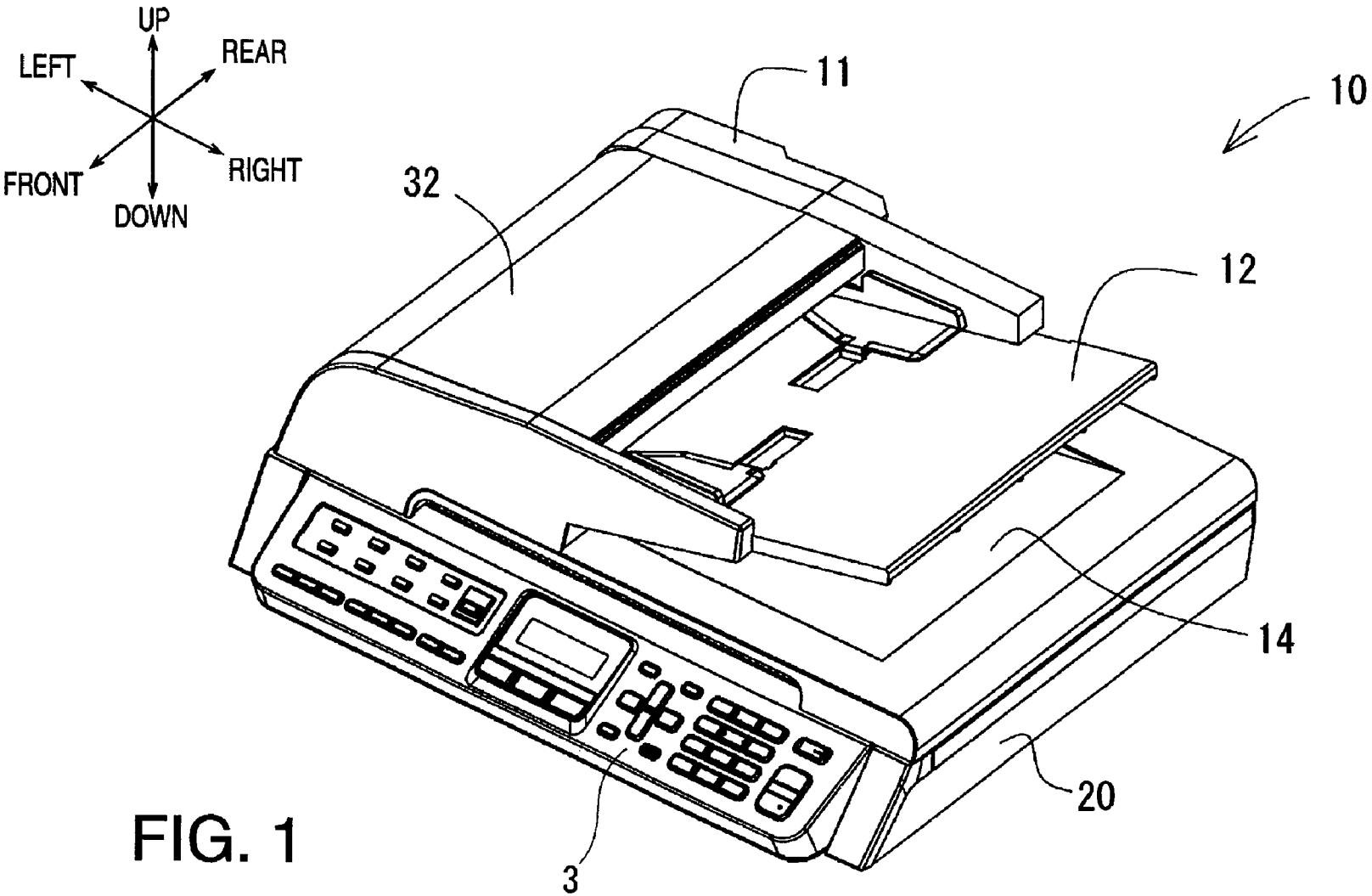
FIG. 1 is an overall perspective view of an image processing apparatus with an ADF in a closed posture according to an embodiment of the present invention.
Figure 2:
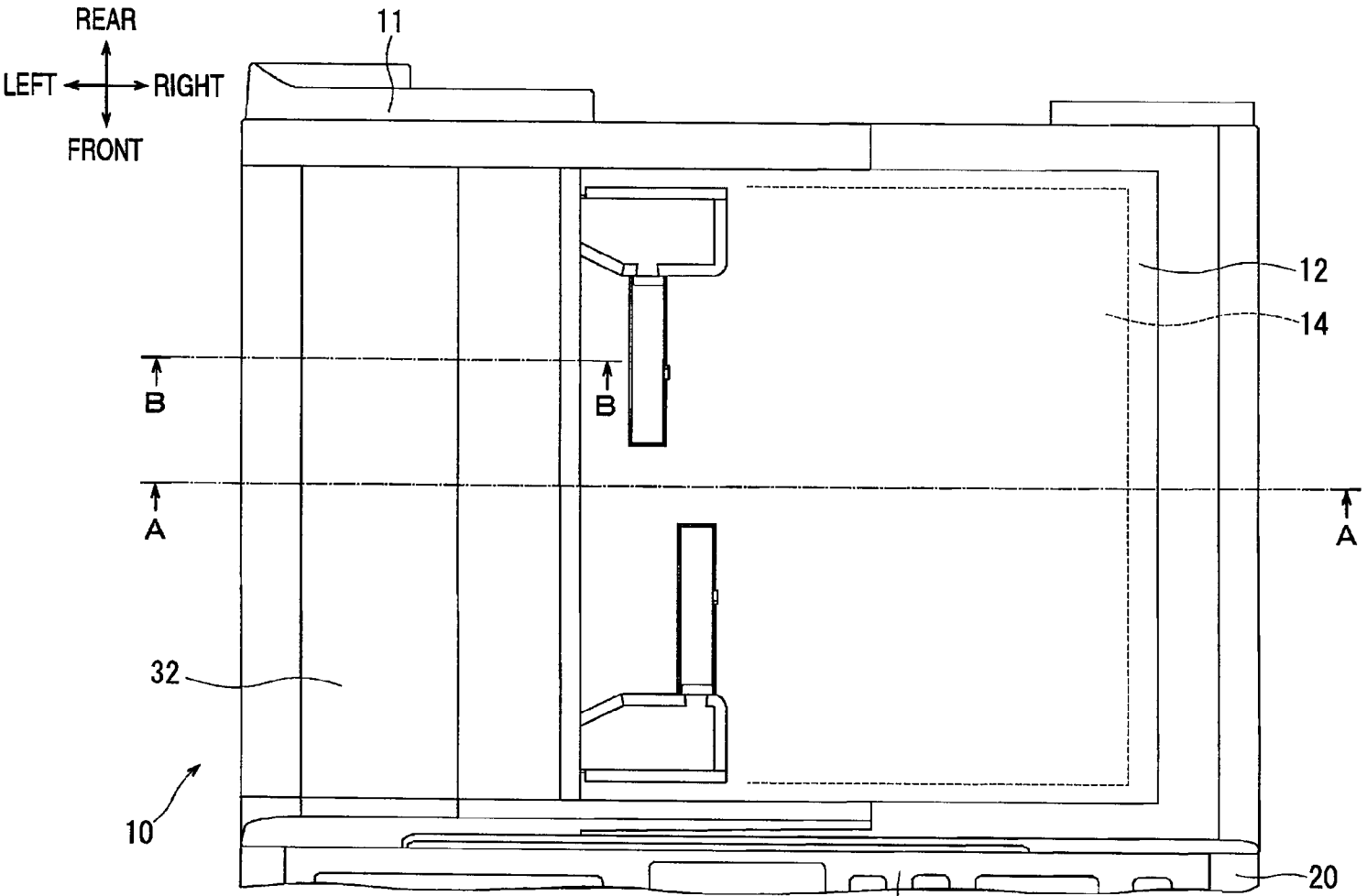
FIG. 2 is a top plan view of the image processing apparatus with the ADF according to the embodiment of the present invention.
Figure 3:
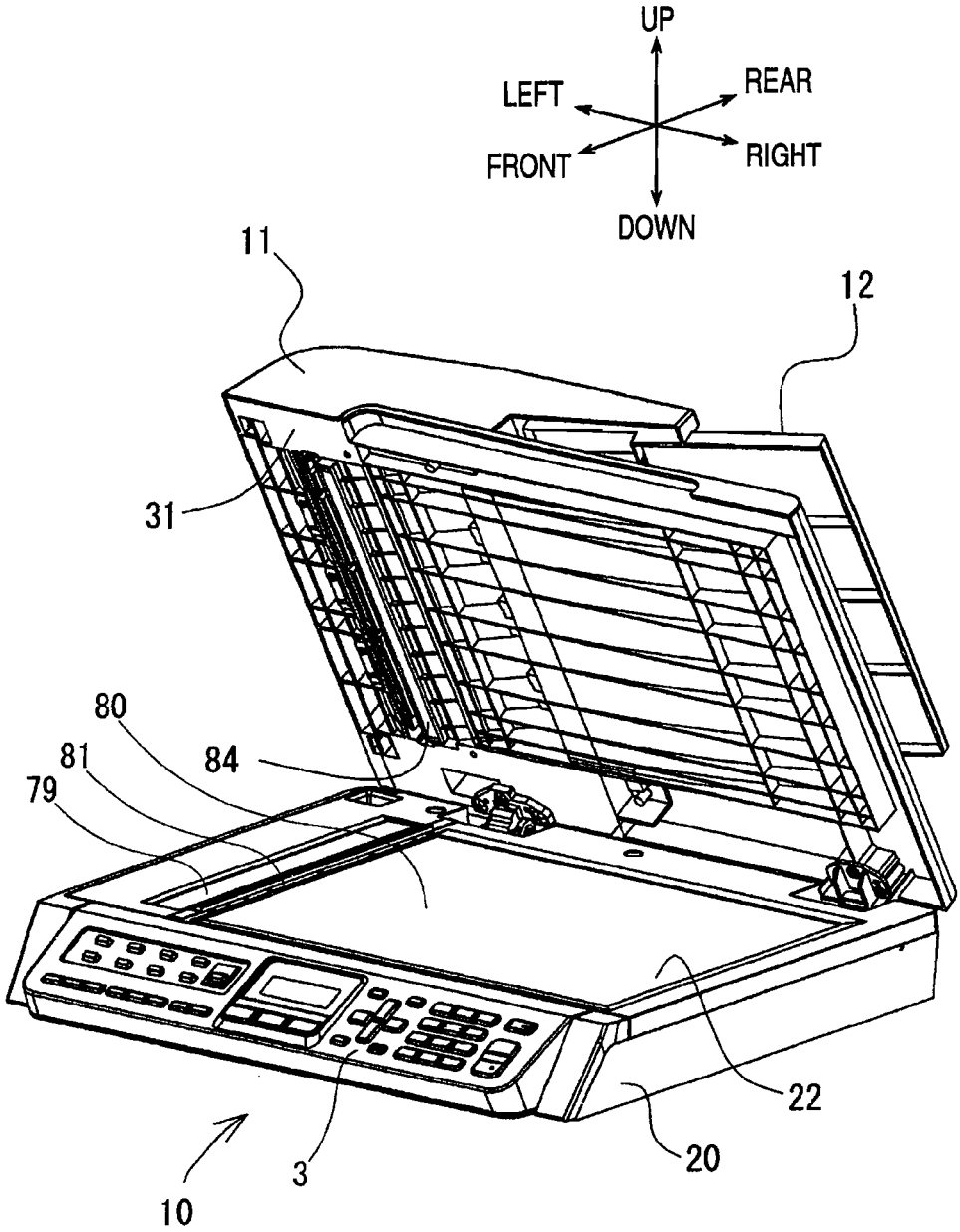
FIG. 3 is a perspective view of the image processing apparatus with the ADF in an open posture according to the embodiment of the present invention.

The image processing apparatus 10 in the present embodiment has known image processing functions, such as a function to read an image formed on a sheet and generate image data representing the read image, and a data transmission function to transmit the generated image data to an external device. As shown in FIGS. 1-3, the image processing apparatus 10 includes an image processing unit 20 and the ADF 11. The ADF 11 is arranged on top of the image processing unit 20. Although not specifically shown in FIG. 1, a lower rear edge of the ADF 11 is supported rotatably to rotate about a shaft (not shown), which extends in the right-left direction along an upper rear edge of the image processing unit 20. Therefore, the ADF 11 can shift postures thereof between a closed position (see FIG. 1) and an open position (see FIG. 3) when a front part of the ADF 11 is uplifted and lowered. As shown in FIG. 3, when the ADF 11 is in the open position, a top surface of the image processing unit 20 is exposed.

2. Image Processing Unit

The image processing unit 20 is provided with the operation panel 3 at a front part thereof. The operation panel 3 is a user interface device to display information concerning operations conducted in the image processing apparatus 10 and can be operated by a user to input information concerning the operations. Further, the image processing unit 20 includes a controller (not shown) to control the ADF 11 and the operation panel 3 and power unit (not shown) inside a chassis thereof.

Figure 4:
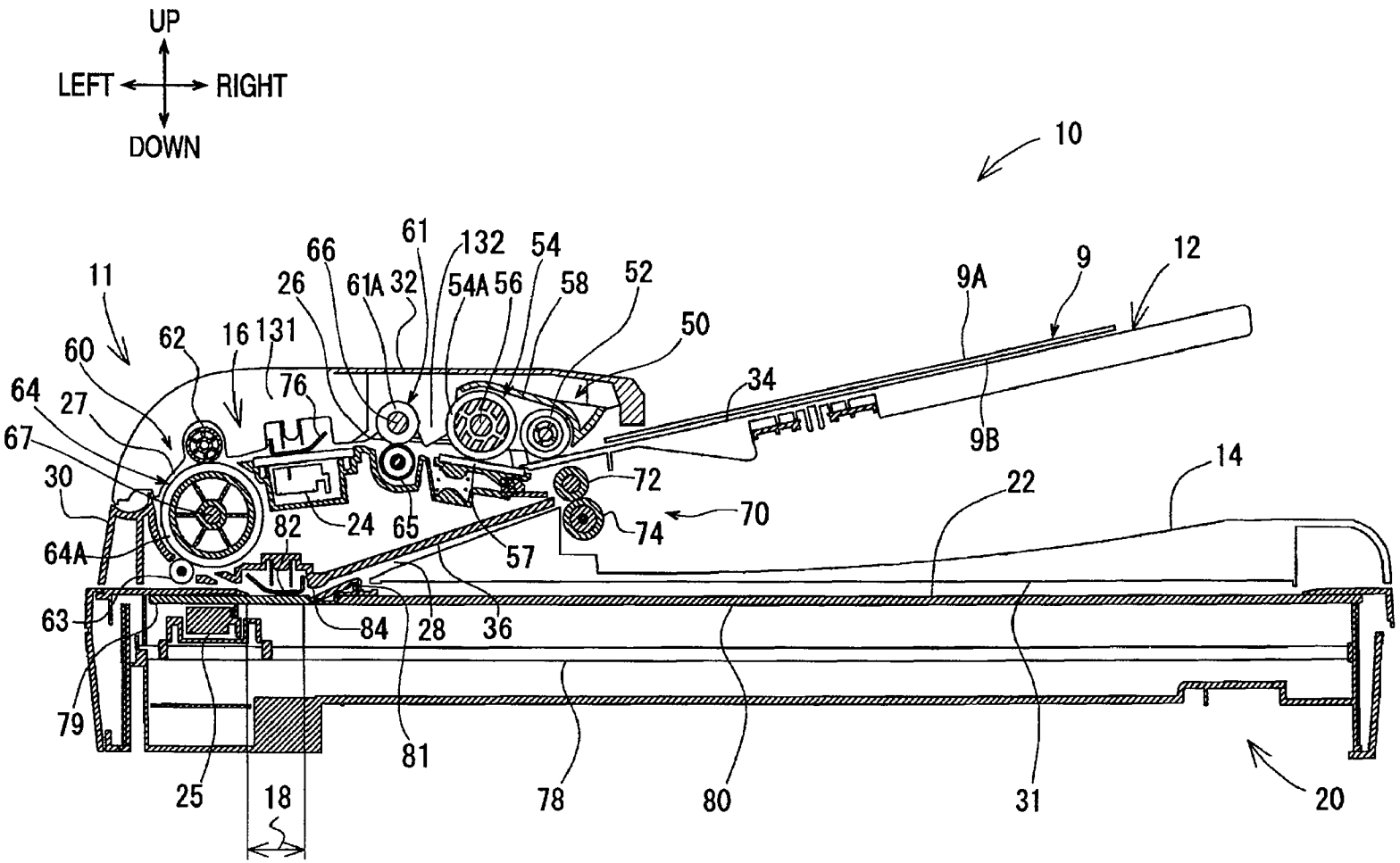
FIG. 4 is a cross-sectional side view of the image processing apparatus according to the embodiment of the present invention taken from a line A-A in FIG. 2.
Figure 5:
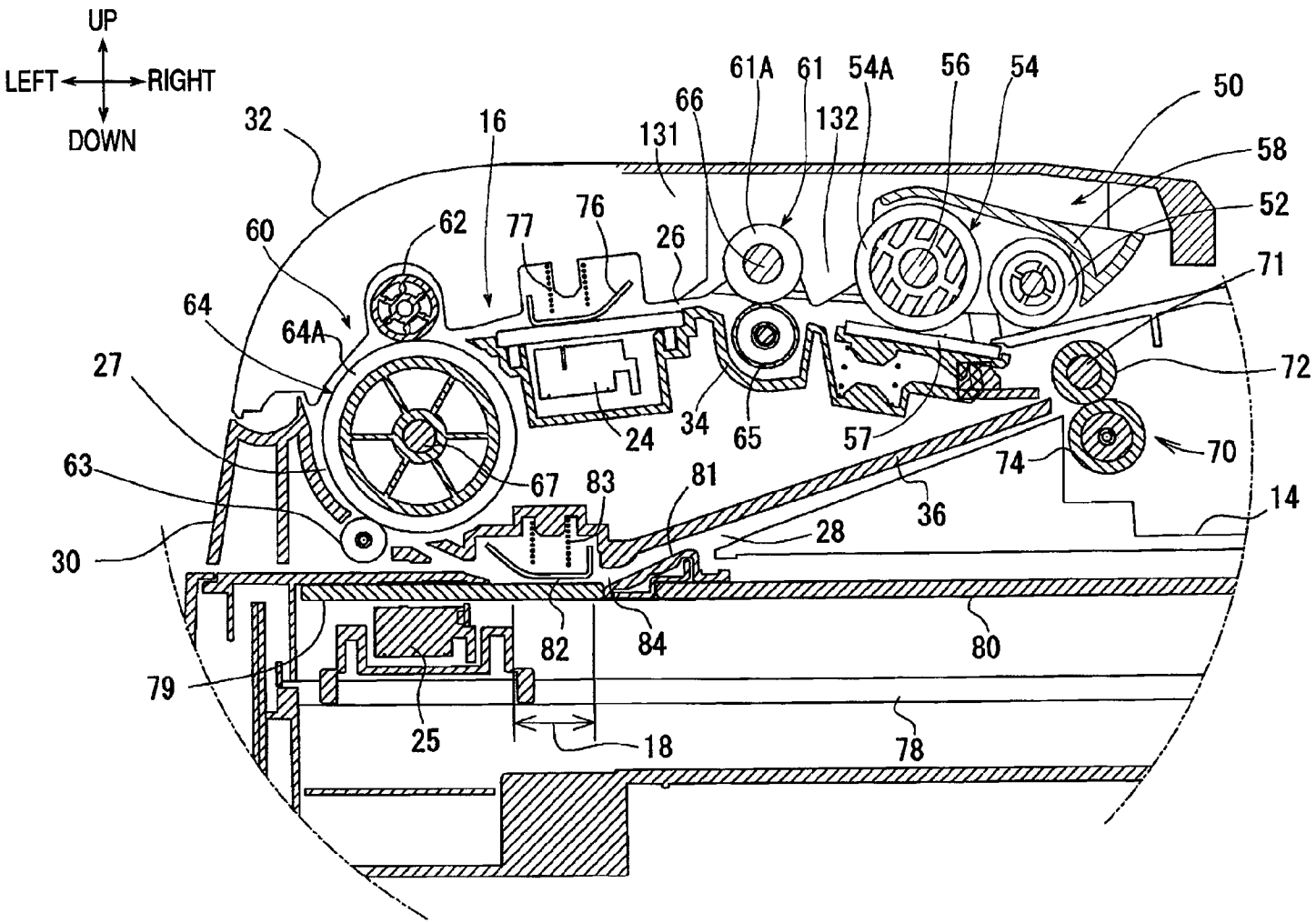
FIG. 5 is an enlarged partial view of the ADF according to the embodiment of the present invention.

As shown in FIGS. 3-5, the image processing unit 20 is provided with a contact glass 22 at a top surface thereof. The contact glass 22 includes two pieces of glasses, which are a fixed-reading glass 79 arranged on the left and a movable-reading glass 80 arranged on the right. A document separator 81, which will be described later in detail, is arranged in a position between the fixed-reading glass 79 and the movable-reading glass 80.

The image processing unit 20 includes a first and a second image sensors 24, 25, which are image processors to read images formed on a sheet 9. The second image sensor 25 is in a position below the contact glass 22 within the chassis. The second image sensor 25 is a known image reading sensor such as, for example, a contact image sensor (CIS) or a charge coupled device (CCD). The second image sensor 25 is slidably set on a slider shaft 78, which extends in the right-left direction in the image processing unit 20. The second image sensor 25 can be therefore slid on the slider shaft 78 in the right-left direction along the slider shaft 78 when driven by a driving mechanism (not shown) such as a pulley-and-belt mechanism. Description of the first image sensor 24 will be provided later.

When an original image formed on an original document such as a sheet of paper or an open-paged book is read by the second image sensor 25, the ADF 11 is not necessarily used. In other words, for example, when the user places the document on the movable-reading glass 80 with the ADF 11 in the open position, the ADF 11 is not used. The second image sensor 25 is moved underneath the fixed-reading glass 79 along the slider shaft 78 from left to right so that the image on the document is sequentially read by the moving second image sensor 25. The read image is converted into data representing the image in a control unit (not shown).

Alternatively, as described below, the second image sensor 25 may be activated in an image reading position 18 below the fixed-reading glass 79 when the ADF 11 is used.

3. ADF

As shown in FIGS. 1-5, the ADF 11 includes a sheet-feed tray 12, on which a plurality of sheets 9 (e.g., paper and OHP films) of original documents can be stacked, and a sheet-discharge tray 14, on which sheets discharged out of a feeding path 16 can be stacked. The sheet-feed tray 12 and the sheet-discharge tray 14 are arranged in vertically overlapping positions. In the present embodiment, the sheet-feed tray 12 is in an upper position above the sheet-discharge tray 14 and on an uppermost stream side of the feeding path 16. Each sheet 9 includes a first surface 9A being a top surface which faces upward and a second surface 9B being a lower surface which faces downward when the sheet is in the sheet-feed tray 12.

Figure 6:
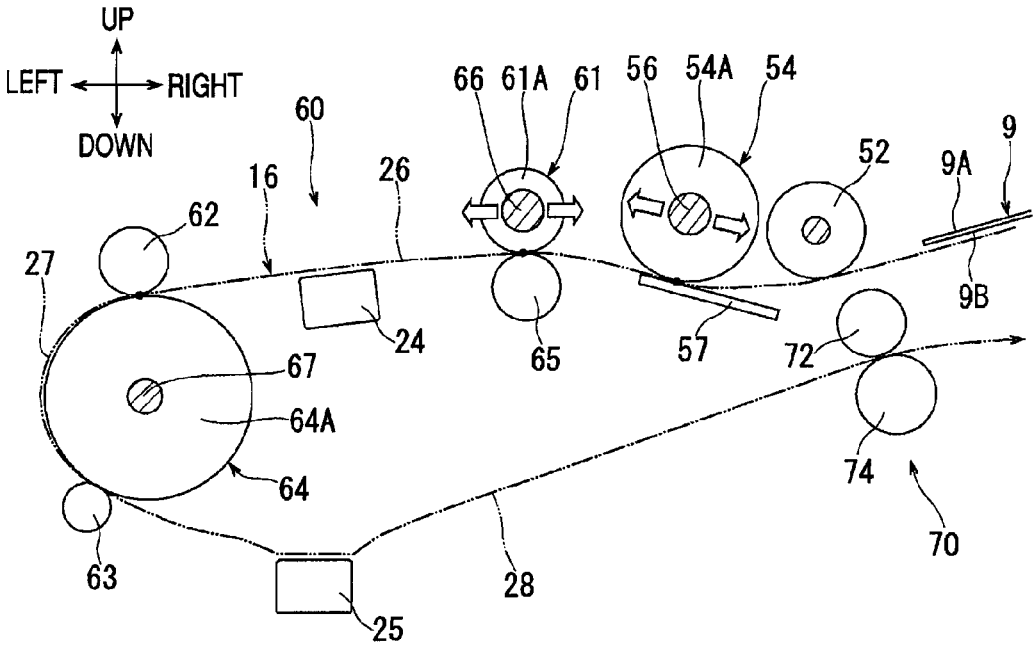
FIG. 6 is a diagram to illustrate a feeding path, a feeding mechanism, a first image sensor, and a second image sensor in the ADF according to the embodiment of the present invention.
Figure 7:
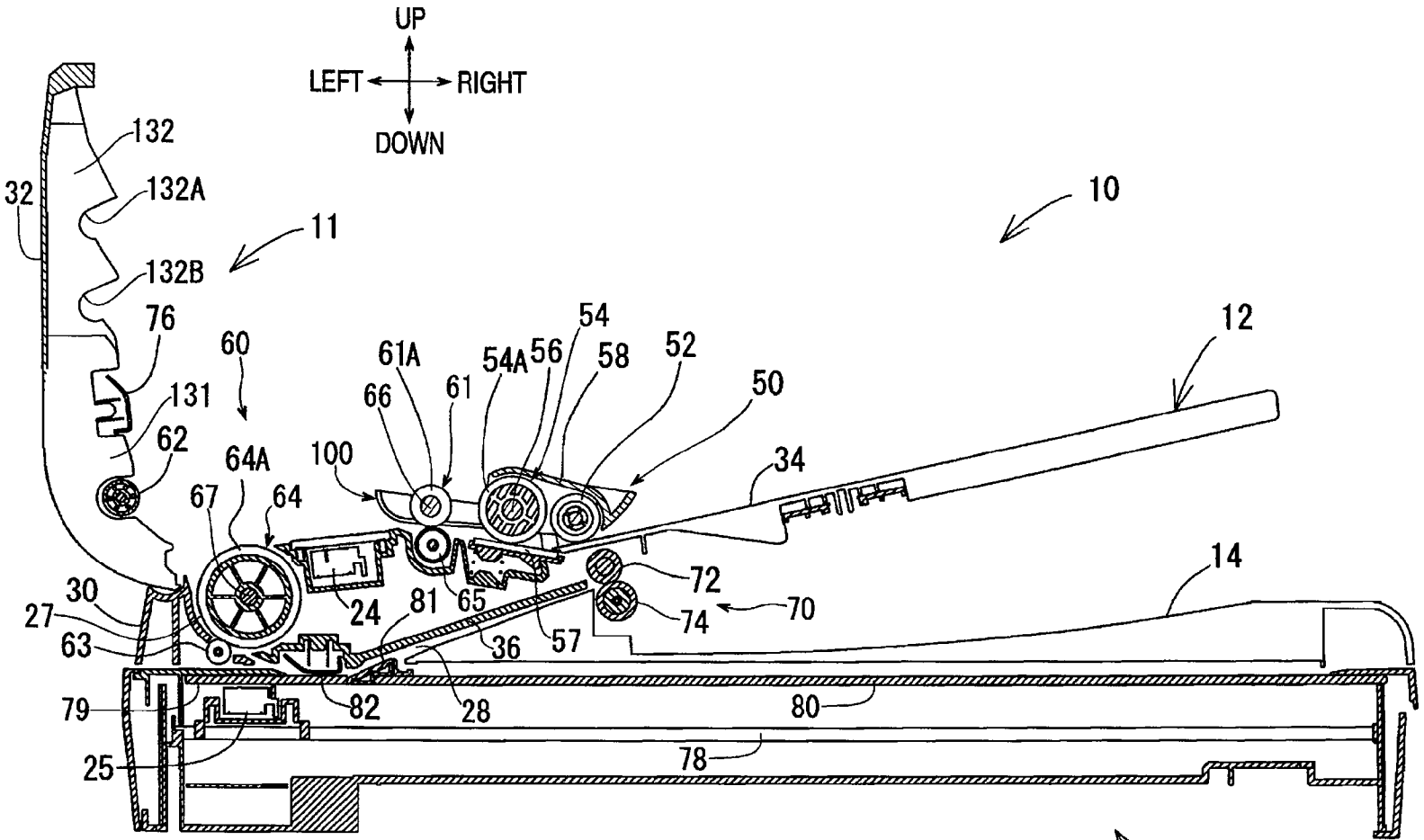
FIG. 7 is a cross-sectional side view of the image processing apparatus according to the embodiment of the present invention with a top cover being open.

As shown in FIGS. 4-6, the ADF 11 picks up the sheets 9 stacked in the sheet-feed tray 12 one-by-one continuously and carries in the feeding path 16. The feeding path 16 is illustrated in a double-dotted line in FIG. 6. The sheets 9 carried in the feeding path 16 are discharged out of the ADF 11 and led to the sheet-discharge tray 14. The ADF 11 has the first image sensor 24, which reads an image formed on the second surface 9B. Further, ADF 11 includes the second image sensor 25, which reads an image formed on the first surface 9A.

3.1 Feeding Mechanism

The feeding mechanism in the ADF 11 of the present embodiment includes a sheet-feed unit 50, conveyer unit 60, and a sheet-discharge unit 70. As shown in FIGS. 4-6, the feeding path 16 in the ADF 11 includes a first feeding path 26, which extends from the sheet-feed tray 12 to the left, a curved feeding path 27, which is continuous from the first feeding path and curved downward, and a second feeding path 28, which is continuous from the curved feeding path 27 and extends to the upper right toward the sheet-discharge tray 14.

The feeding mechanism in the ADF 11 has a base structure including a main frame 30, an upper guide 34, and a lower guide 36. The main frame 30 has two sides defining front and rear ends of the ADF 11 and a bottom surface defining a bottom of the ADF 11 (see also FIGS. 8-10). The upper guide 34, extending from the sheet-feed tray 12 to an area in vicinity of a main roller 64, holds the sheets 9 in the sheet-feed tray 12 from below and defines the first feeding path 26 to be partitioned from lower space. The lower guide 36 is a plate defining the second feeding path 28 and extends from an area below the main roller 64 toward an area in vicinity of the sheet-discharge unit 70, which will be described later in detail.

The feeding mechanism in the ADF 11 further includes a top cover 32, which is arranged to cover a left-side part of the ADF 11 with respect to the upper guide 24. A left-side edge of the top cover 32 is swingably supported by a left-side edge of the main frame 30. When a right-hand end of the top cover 32 is uplifted to rotate about the left-side edge, the top cover 32 in a closed position (see FIG. 4) is shifted in an open position (see FIG. 7).

The upper guide 34 includes a right-side part and a left-side part. As shown in FIG. 5 and in FIG. 8, in which the top cover 32 is omitted, the left-side part of the upper guide 34 is fixed to upper-left portions of the main frame 30. Meanwhile, as shown in FIG. 9, in which the top cover 32 and the upper guide 34 are omitted, the lower guide 36 is fixed to lower-left portions of the main frame 30. Thus, as shown in FIG. 4, the left-side part of the upper guide 34 and the lower guide 36 are arranged in positions which vertically overlap each other.

The right-side part of the upper guide 34 is a flat plate extending from an area in the vicinity of the right-side edge of the left-side part of the upper guide 34 toward upper-right in an inclined posture (see FIG. 4). The right-side part of the upper guide 34 corresponds to the sheet-feed tray 12 to hold the sheets 9 from below. Meanwhile, the main frame 30 is formed to have a recessed portion on a right-hand side with respect to the lower guide 36. The recessed portion corresponds to the sheet-feed tray 14 to store the discharged sheets 9 therein.

When the top cover 32 is in the open position (see FIG. 7), the left-side part of the upper guide 34, the sheet-feed unit 50, and the conveyer unit 60, which will be described later, are exposed. Therefore, when the sheet 9 is jammed in the ADF 11, the top cover 32 in the open position allows the user to access the left-side part of the upper guide 34, a sheet-feed unit 50, and a conveyer unit 60 so that the jammed sheet 9 can be removed by the user therefrom.

The top cover 32 is formed to have a plurality of reinforcing ribs 131, 132 on an inner side thereof. The ribs 131, 132 project downwards, when the cover 32 is in the closed position, and extend between the right-side edge and the left-side edge of the top cover 32 along the first feeding path 26 and the curved feeding path 27.

The ribs 131 are formed in a center portion with respect to the front-rear direction of the top cover 32 to extend between the right-side edge and the left-side edge of the top cover 32 along the first feeding path 26 and the curved feeding path 27. However, the ribs 131 are partially omitted in a portion, which may otherwise interfere with components inside the top cover 32 being in the closed position. The ribs 132 are formed on each side of the ribs 131 along the front and rear edges of the top cover 32. The ribs 132 are formed to have cutouts 132A, 132B to prevent interference with a first shaft 56 and a second shaft 66, which will be described later in detail.

As shown in FIGS. 4 and 5, when the top cover 32 is in the closed position, the left-side part of the upper guide 34 is covered with the top cover 32, and edges of the ribs 131, 132 formed on the top cover 32 and the upper guide 34 define the first feeding path 26. In other words, the ribs 131, 132 on the top cover 32 serve as guiding edges to guide the sheets 9 in the first feeding path 26.

The main roller 64 in the ADF 11 is arranged in a position between; the left-side edges of the main frame 30 and the ribs 131, 132 of the top cover 32; and the left-side edges of the upper guide 34 and the lower guide 36. The main roller 64 is arranged to have an outer periphery thereof to be apart from the left-side edges of the main frame 30 and the ribs 131, 132 of the top cover 32 so that a clearance, i.e., the curved feeding path 27, is formed in between the outer periphery of the main roller 64 and the left-side edges of the main frame 30 and the ribs 131, 132 of the top cover 32. In other words, the left-side edge of the main frame 30, the left-side edges of the ribs 131, 132, and the outer periphery of the main roller 64 serve as guiding edges to guide the sheets 9 in the curved feeding path 27.

The second feeding path 28 is formed in between the main frame 30 and the lower guide 36. In other words, the lower guide 36 serves as a guiding edge to guide the sheets 9 in the second feeding path 28. As shown in FIGS. 3-5, a bottom surface 31 of the ADF 11 has a linearly-formed opening 84, extending in the front-rear direction when the ADF 11 is in the closes position, in vicinity of a bordering area between the curved feeding path 27 and the second feeding path 28. The bordering area between the curved feeding path 27 and the second feeding path 28 is exposed to the bottom surface 31 through the opening 84.

When the sheet 9 is conveyed in the curved feeding path 27 to the second feeding path 28, the sheet 9 being conveyed is exposed to the fixed-reading glass 79 through the opening 84. When the exposed sheet 9 is further conveyed in the second feeding path 28, the document separator 81, which is arranged in the vicinity of the position between the fixed-reading glass 79 and the movable-reading glass 80, directs the sheet 9 securely in the second feeding path 28.

3.1.1 Sheet-Feed Unit

As shown in FIGS. 4-6, the sheet-feed unit 50 is arranged on an upper-stream side of the first feeding path 26 closer to the sheet-feet tray 12 and picks up the sheets 9 stacked in the sheet-feed tray 12 one-by-one to feed in the first feeding path 26 toward a downstream side of the first feeding path 26. The sheet-feed unit 50 includes a pickup roller 52, a separator roller 54, and a separator pad 57, which are arranged above the upper guide 34 on the upper-stream side of the first feeding path 26.

As shown in FIG. 9, the separator roller 54 includes a first shaft 56 and a separator 54A being a body of the separator roller 54. The first shaft 56 is rotatably supported by the main frame 30 at a front end 56A and a rear end 56B thereof. The separator 54A is fixed to an axially midst portion of the first shaft 56. The rear end 56B of the first shaft 56 is connected to a motor (not shown) via a drive force conveyer 99 having a plurality of gears. Thus, the first shaft 56 is rotated by the motor in a predetermined rotational direction (i.e., clockwise in FIG. 4), and the separator 54A is rotated accordingly along with the first shaft 56. The first shaft 56 is a steel round bar, and an outer diameter thereof may range from a few to a dozen millimeters.

The first shaft 56 is provided with a swingable holder 58, which covers an upper side of the separator 54A and extends toward the upper-stream side of the first feeding path 26 (see FIG. 5). The holder 58 rotatably holds the pickup roller 52 at the extending part thereof. The pickup roller 52 is coupled to the first shaft 56 through gears (not shown), which are arranged within the holder 58. Accordingly, when the first shaft 56 rotates, the pickup roller 52 rotates in the clockwise direction as well as the separator 54A. As the pickup roller 52 is rotated, the holder 58 is urged to swing toward the upper guide 34 by the rotation. In the present embodiment, the pickup roller 52 and the separator 54A are configured to have equal circumferential velocities.

As shown in FIGS. 4-6, the separator pad 57 is arranged in a position opposite from the separator 54A across the first feeding path 26. The separator pad 57 is pressed upward to an outer peripheral surface of the separator 54A. The separator pad 57 may be formed of, for example, cork chips and causes friction with the second surface 9B of the sheet 9 which is carried on the separator pad 57.

The pickup roller 52 is rotated in accordance with the rotation of the first shaft 56 of the separator roller 54 with the outer peripheral surface thereof being in contact with the first surface 9A of the topmost sheet 9 amongst the sheets 9 stacked in the sheet-feed tray 12. Thus, the rotation force of the pickup roller 52 is conveyed to the sheet 9, and the sheet 9 is carried in the first feeding path 26. When the topmost sheet 9 is picked up by the pickup roller 52, however, one or more subsequent sheets 9 may be picked up along with the topmost sheet 9. When such subsequent sheets 9 are carried to the separator 54A and the separator pad 57, the subsequent sheets 9 are separated from the topmost sheet 9 by the friction in the separator pad 57 so that solely the topmost sheet 9 is further carried in the first feeding path 26.

3.1.2 Conveyer Unit

As shown in FIGS. 4-6, the conveyer unit 60 carries the sheet 9, picked up from the sheet-feed tray 12 by the sheet-feed unit 50, in the first feeding path 26, the curved feeding path 27, and the second feeding path 28. The conveyer unit 60 includes a conveyer roller 61, the main roller 64, and pinch rollers 62, 65. The conveyer roller 61 is arranged above the upper guide 34 on the left-hand side with respect to the separator roller 54 (i.e., the lower-stream side than the separator roller 54 in the first feeding path 26). The main roller 64 is arranged in the position to define the curved feeding path 27.

As shown in FIG. 9, the conveyer roller 61 includes a second shaft 66 and a conveyer 61A being a body of the conveyer roller 61. The second shaft 61 is rotatably supported by the main frame 30 at a front end 66A and a rear end 66B thereof. The conveyer 61A is fixed to an axially midst portion of the second shaft 66. The rear end 66B of the second shaft 66 is connected to a motor (not shown) via the drive force conveyer 99. Thus, the second shaft 66 is rotated by the motor in the predetermined direction (i.e., clockwise in FIG. 4), and the conveyer 61A is rotated accordingly along with the second shaft 66. The second shaft 66 is a steel round bar, and an outer diameter thereof may range from a few to a dozen millimeters. The first shaft 56 and the second shaft 66 tend to be formed to have smaller diameters for manufacturing cost reduction.

According to the present embodiment, the peripheral velocity of the conveyer 61A is faster than that of the separator 54A. Due to the speed difference, clearance between the sheets 9, which are separated by the separator 54A and the separator pad 57, is maintained. Moreover, the separator roller 54 is provided with a buffer (not shown) in between the first shaft 56 and the separator 54A to absorb the speed difference between the separator 54A and the conveyer 56A. Therefore, when the conveying force is applied to the sheet 9 in the first feeding path 26 with the conveyer 61A and the separator 54A in contact with the first surface 9A of the sheet 9, the speed difference is absorbed by the buffer so that the sheet 9 is not carried in different conveying speeds. More specifically, the separator 54A is normally rotated by the motor except when the sheet 9 is in contact with the conveyer 61A and the separator 54A simultaneously. In other words, the separator 54A is driven to rotate by the conveyer 61A via the sheet 9 specifically when the first surface 9A of the sheet 9 is in contact with the conveyer 61A and the separator 54A.

As shown in FIGS. 4-6, the pinch roller 65 is arranged a position opposite from the conveyer 61A across the first feeding path 26. The sheet 9 conveyed forward by the separator roller 54 is nipped with the conveyer 61A and the pinch roller 65. Therefore, the sheet 9 with the first surface 9A thereof in contact with the conveyer 61A is carried in the first feeding path 26 by the conveying force of the rotating conveyer roller 61. The sheet 9 is thus carried to the curved feeding path 27.

As shown in FIG. 9, the main roller 64 includes a third shaft 67 and three (3) roller bodies 64A. The third shaft 67 is rotatably supported by the main frame 30 at a front end 67A and a left end 67B thereof. The roller bodies 64A are fixed to an axially midst portion of the third shaft 67 with clearance in between them The third shaft 67 is provided with a pair of intermediate bearings at the axially midst portion to have the three roller bodies 64A in between the intermediate bearings. The rear end 67B of the third shaft 67 is connected to the motor (not shown) via the drive force conveyer 99. Thus, the third shaft 67 is rotated by the motor in a predetermined direction (i.e., counterclockwise in FIG. 4), and the roller bodies 64A are rotated accordingly along with the third shaft 67. According to the present embodiment, the peripheral velocity of the roller bodies 64A is faster than that of the conveyer 61A of the conveyer roller 61. Due to the speed difference, the sheet 9 being conveyed is prevented from being loosened in between the main roller 64 and the conveyer roller 61.

As shown in FIGS. 4-6, the pinch rollers 62, 63 are arranged in positions opposite from the main roller 64A across the curved feeding path 27. The sheet 9 conveyed in the curved feeding path 27 is nipped with the roller bodies 64A and the pinch rollers 62 at the upper stream side of the curved feeding path 27, and with the roller bodies 64A and the pinch rollers 63 at a lower-stream side of the curved feeding path 27. Therefore, the sheet 9 with the second surface 9B in contact with the roller bodies 64A is carried in the curved feeding path 27 by the conveying force of the rotation of the main roller 64. Thus, the sheet 9 is carried to the second feeding path 28.

3.1.3 Sheet-Discharge Unit

As shown in FIGS. 4-6, the sheet-discharge unit 70 discharges the sheet 9 having been conveyed in the second feeding path 28 by the conveyer unit 60 out to the feed-discharge tray 14. The sheet-discharge unit 70 includes a discharge roller 72 and pinch rollers 74, which are arranged in vicinity of the right-side end of the lower guide 36 on a downstream side of the second feeding path 28. As shown in FIG. 9, the discharge roller 72 includes a fourth shaft 71. The fourth shaft 71 is rotatably supported by the main frame 30 at a front end 71A and a rear end 71B thereof. The rear end 71B of the fourth shaft 71 is connected to the motor (not shown) via the drive force conveyer 99. Thus, the fourth shaft 71 is rotated by the motor in a predetermined direction (i.e., counterclockwise in FIG. 4), and the discharge roller 72 is rotated accordingly along with the fourth shaft 71.

As shown in FIGS. 4-6, the sheet 9 carried in the second feeding path 28 is nipped with the discharge roller 72 and the pinch rollers 74 and discharged out of the second feeding path 28 to the sheet-discharge tray 14.

3.2 First Image Sensor

The first image sensor 24, shown in FIGS. 4-6, is a known image reading sensor such as, for example, a CIS or a CCD. The first image sensor 24 is embedded in a recessed portion on the left-hand side in the upper guide 34 with a top surface thereof being exposed. That is, the first image sensor 24 is arranged on a lower-stream side with respect to the conveyer roller 61 and an upper-stream side with respect to the main roller 64. The sheet 9 being conveyed in the first feeding path 26 is transferred above the first image sensor 24 with the second surface 9B being exposed to the first image sensor 24.

In a position opposite from the first image sensor 24 across the first feeding path 26, a first white piece 76 is provided. The first white piece 76 is resiliently pressed toward the first image sensor 24 by a coil spring 77 (see FIG. 5). Thus, when the sheet 9 is conveyed in the first feeding path 26 between the first image sensor 24 and the first white piece 76, the sheet 9 is pressed toward the first image sensor 24 by the first white piece 76. Accordingly, the first image sensor 24 reads an image formed on the second surface 9B of the sheet 9 pressed closer to the first image sensor 24. The image read by the first image sensor 24 is transferred to the control unit of the image processing apparatus, in which image data representing the read image is created.

3.3 Second Image Sensor

As shown in FIGS. 4-6, the second image sensor 25 is moved to stop at a predetermined image reading position 18 when the ADF 11 is used. When the second image sensor 25 is in the image reading position 18, an upper surface of the second image sensor 25 faces the opening 84 in the second feeding path 28 through the fixed-reading glass 79. With the second image sensor 25 facing the opening 84, when the sheet 9 is carried in the second feeding path 28 to the image reading position 18 by the conveyer unit 60, the sheet 9 passes above the upper surface of the second image sensor 25. When the sheet 9 is further conveyed in the second feeding path 28, the document separator 81 directs the sheet 9 to be away from the fixed-reading glass 79.

Further, in a position opposite from the second image sensor 25 in the image reading position 18 across the second feeding path 28, a second white piece 82 is provided. The second white piece 82 is resiliently pressed toward the image sensor 25 at the image reading position 18 by a coil spring 83 (see FIG. 5). Thus, when the sheet 9 is conveyed in the second feeding path 28 between the second image sensor 25 and the second white piece 83, the sheet 9 is pressed toward the second image sensor 25 by the second white piece 83. Accordingly, the second image sensor 25 reads an image formed on the first surface 9A of the sheet 9 pressed closer to the second image sensor 25. The image read by the second image sensor 25 is transferred to the control unit of the image processing apparatus, in which image data representing the read image is created.

3.4 Sheet Detectors

Figure 8:
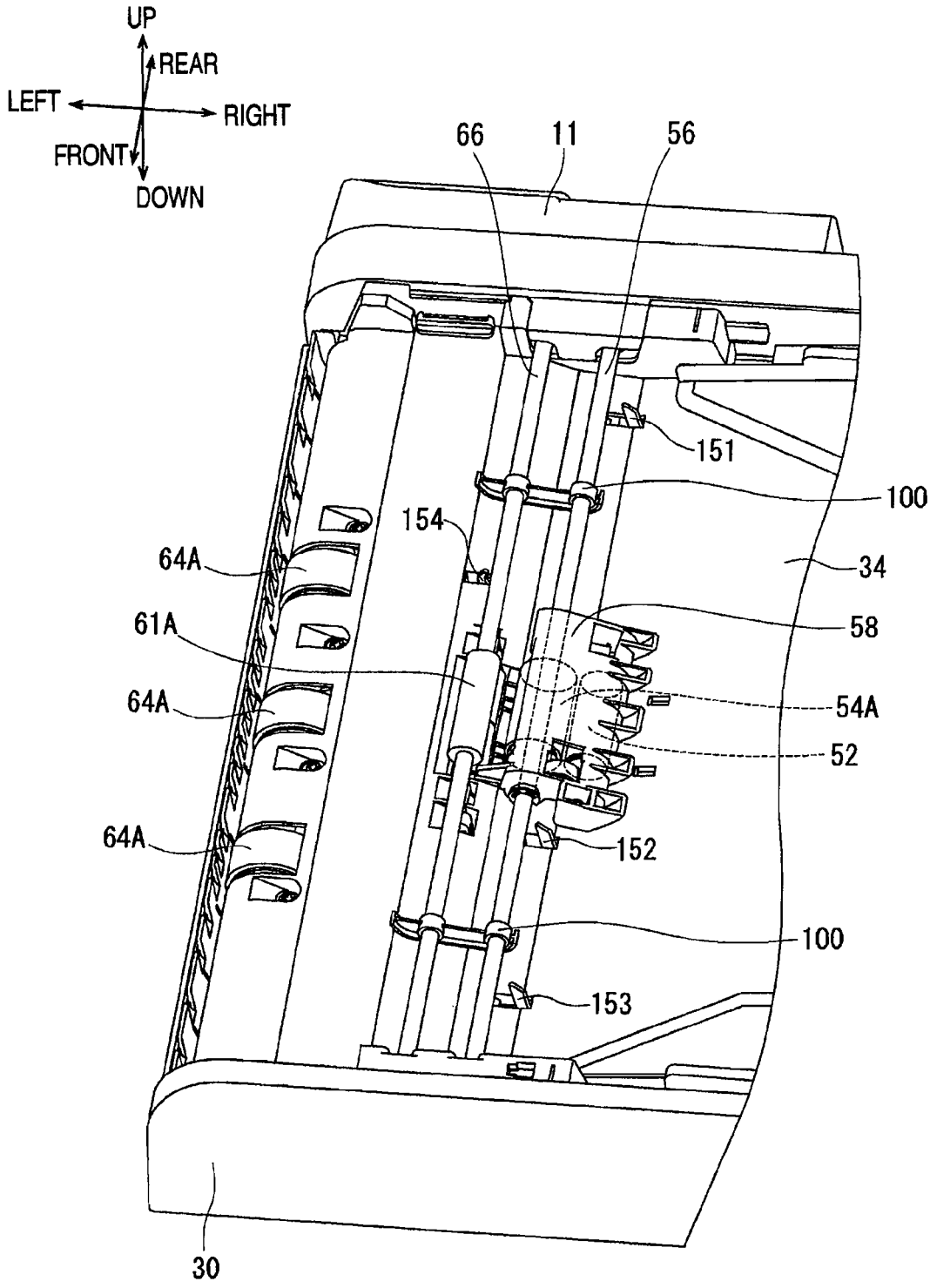
FIG. 8 is a perspective partial view of the ADF according to the embodiment of the present invention with the top cover being removed.
Figure 9:
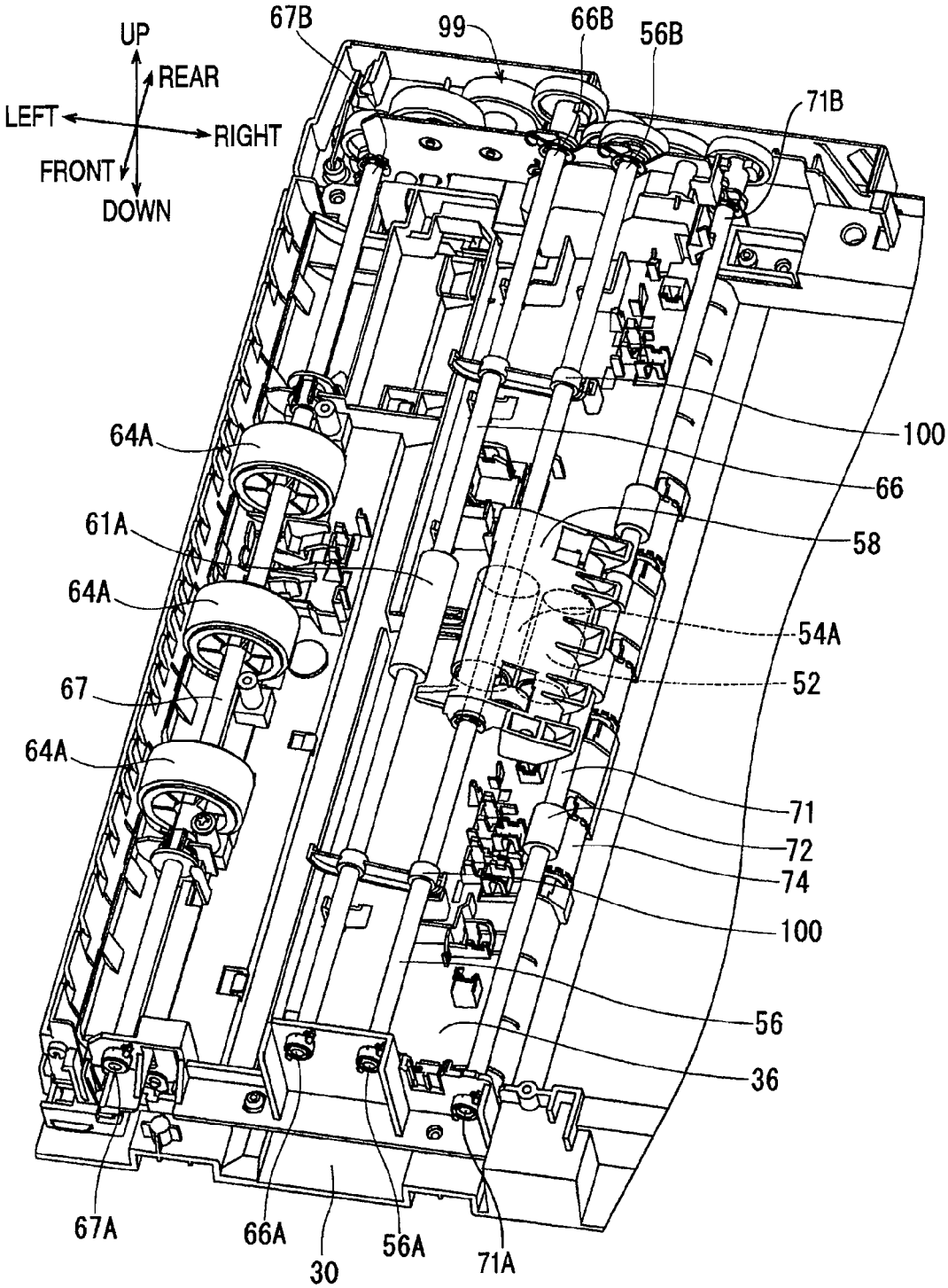
FIG. 9 is a perspective partial view of the ADF according to the embodiment of the present invention with the top cover and an upper guide being removed.
Figure 10:
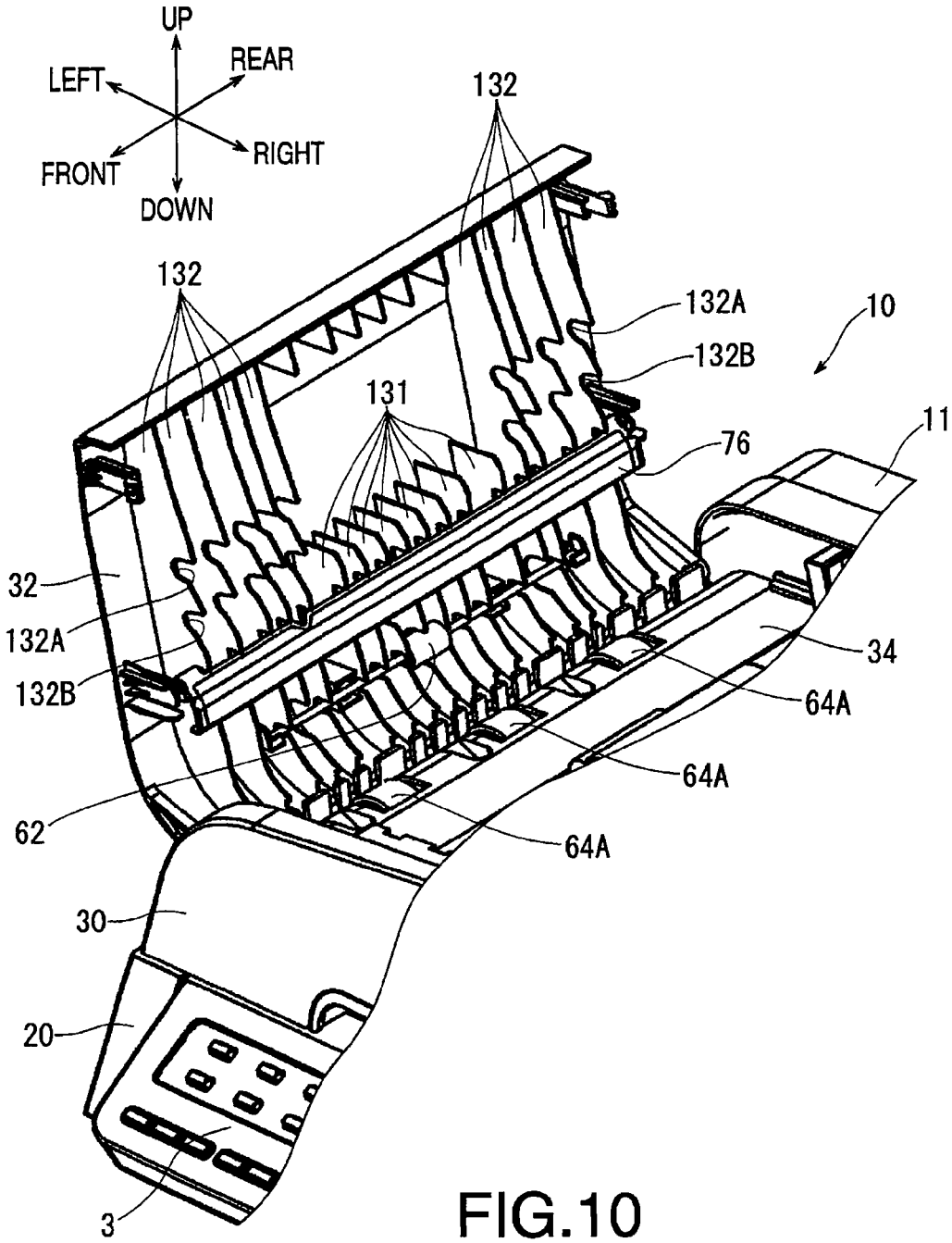
FIG. 10 is a perspective view of the top cover being open in the ADF according to the embodiment of the present invention.

As shown in FIG. 8, the conveyer unit 60 includes four pieces of sheet detectors 151, 152, 153, 154. The sheet detectors 151-153 are arranged in the vicinities of and below the first shaft 56 to detect a front end of the sheet 9 set in the sheet-feed unit 50. The sheet detector 154 is arranged in the vicinity of and below the second shaft 66 and detects the front end of the sheet 9 reaching the vicinity of the second shaft 66. The sheet detectors 151-154 are in similar configuration; therefore, explanation of the sheet detectors 152-154 is represented by that of the sheet detector 151 described below. In the description hereinbelow, in terms of the sheet 9 in the feeding path 16, the "front end" refers to an edge of the sheet 9 proceeding in front in the feeding path 16.

Figure 11:
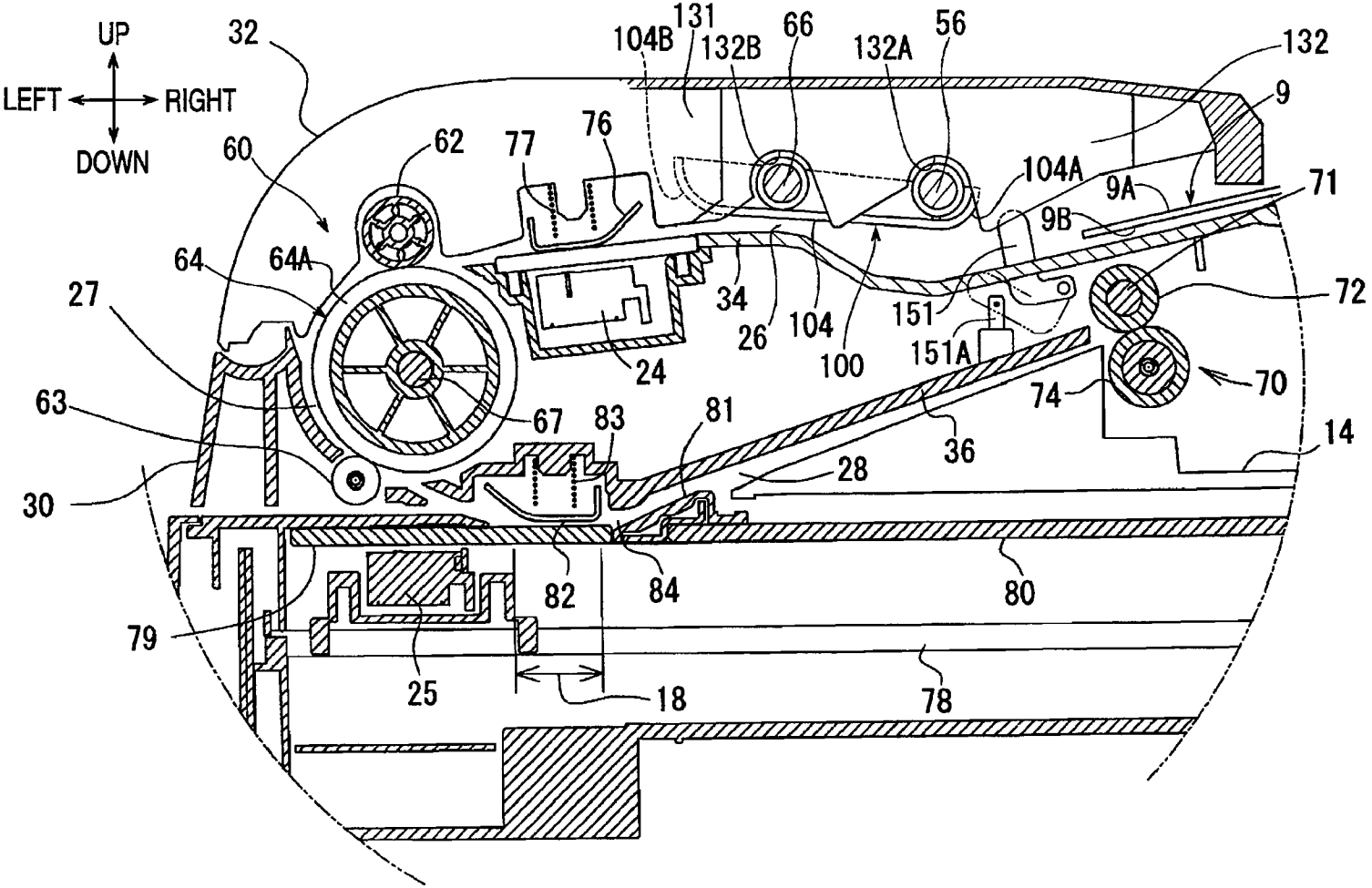
FIG. 11 is a cross-sectional partial view of the ADF according to the embodiment of the present invention taken from a line B-B in FIG. 2.

As shown in FIGS. 8 and 11, the sheet detector 151 is swingably supported by the upper guide 34 and is normally resiliently upraised by a biasing member (not shown) in an uprising position as illustrated in a solid line in FIG. 11. The upper guide 34 is formed to have an opening, through which the uprising sheet detector 151 penetrates to protrude upward from the upper surface of the upper guide 34. Therefore, when no sheet is set in the sheet-feed unit 50, the sheet detector 151 is not in contact with the sheet. When the sheet detector 151 is cleared from the sheet, the sheet detector 151 intersects the first feeding path 26.

When sheets 9 are set on the sheet-feed tray 12, and the front ends of the sheets 9 are inserted in the sheet-feed unit 50, the sheet detector 151 is pressed by the front ends of the sheets 9 downward to a lower position, as indicated in a double-dotted line in FIG. 11, below the second surface 9B of the sheet 9. Accordingly, the sheet detector 151 is displaced out of the first feeding path 26 and no longer intersects the first feeding path 26. Meanwhile, in the vicinity of the sheet detector 151 below the upper guide 34, a displacement sensor (e.g., a photo-interrupter) 151A is provided to detect the displacement of the sheet detector 151 out of the first feeding path 26. Accordingly, the displacement sensor 151A can inform the control unit of the presence of the sheet 9 in the sheet-feed unit 50.

3.5 Automatic Document Reading Operation of ADF

When one or more sheets 9 are set on the sheet-feed tray 12, and the front ends of the sheets 9 are inserted below the right-side end of the top cover 32 in the sheet-feed unit 50, the sheet detectors 151-153 and the displacement sensors 151A inform the control unit of the presence of the sheets 9. When the user uses the operation panel 3 to enter an instruction to start reading the images on the sheets 9, the control unit manipulates the ADF 11 to start an automatic reading operation. Thus, the sheets 9 in the sheet-feed tray 12 are picked up separately and carried in the first feeding path 26 one-by-one. When the sheet detector 154 detects the sheet 9 reaching the vicinity of the second shaft 66, the sheet detector 154 informs the control unit of the presence of the sheet 9, and the control unit maintains the automatic reading operation in response to the information. As the sheet 9 is carried further in the first feeding path 26 to pass by the first image sensor 24, the image formed on the second surface 9B of the sheet 9 is read by the first image sensor 24. The sheet 9 is further carried to the curved feeding path 27 and turned over to have the first and second surfaces 9A, 9B reversed in the curved feeding path 27. When the sheet 9 is carried to pass by the second sensor 25, the image formed on the first surface 9A of the sheet 9 is read by the second image sensor 25. The sheet 9 is carried further in the second feeding path 28 and discharged in the sheet-discharge tray 14 with the first surface 9A facing downward. The automatic reading operation is automatically repeated until all the sheets 9 in the sheet-feed tray 12 are processed in the feeding path 16 and no more sheet 9 remains in the sheet-feed tray 12.

As mentioned above, in the present embodiment, the "front end" in terms of the sheet 9 refers to an edge of the sheet 9 proceeding in front in the feeding path 16. In other words, when the sheet 9 is in the first feeding path 26, the front end of the sheet 9 is the leftmost end in FIGS. 4-6. After the sheet 9 is reversed in the curved feeding path 27, in the second feeding path 28, the front end is the rightmost end in FIG. 4-6.

4. Connector Pieces

Figure 12:
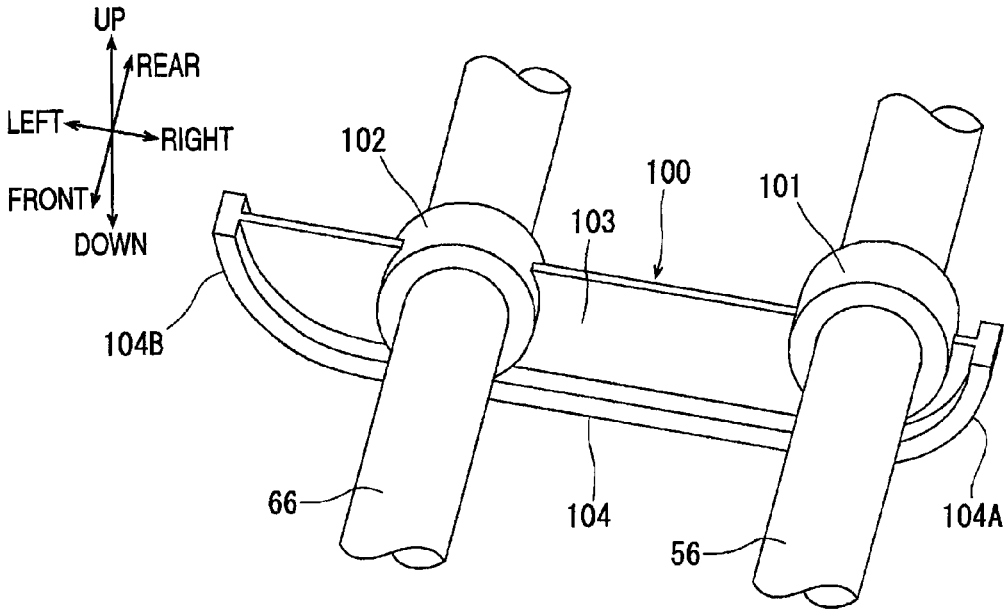
FIG. 12 is an enlarged perspective view of a first shaft, a second shaft, and a connector piece in the ADF according to the embodiment of the present invention.

As shown in FIGS. 8 and 12, the conveyer unit 60 in the present embodiment includes connector pieces 100 attached to the first shaft 56 and the second shaft 66. The connector pieces 100 will be described below. Prior to description of the connector pieces 100, however, assumable behaviors of the first shaft 56 and the second shaft 66 without the connector pieces 100 will be described below.

As shown in FIG. 6, when the separator roller 54 and the conveyer roller 64, rotatably supported at the axial ends thereof, are rotated to apply conveying force to the sheet 9, reaction force of the conveying force is applied from the sheet 9 to the first and second shafts 56, 66 via the separator 54A and the conveyer 61A.

When the separator roller 54 and the separator pad 57 separates the sheets 9, friction force generated in the separator pad 57 with the sheet 9 affects the first shaft 56 and the second shaft 66 via the separator 54A and the conveyer 61A.

When the main roller 64 is rotated to convey the sheet 9, tensile force in the sheet 9 caused by the difference of the peripheral velocities between; the separator roller 54A and the conveyer rollers 61A; and the roller bodies 64A affects the first and second shafts 56, 66 via the separator 54A and the conveyer 61A.

Figure 13A:
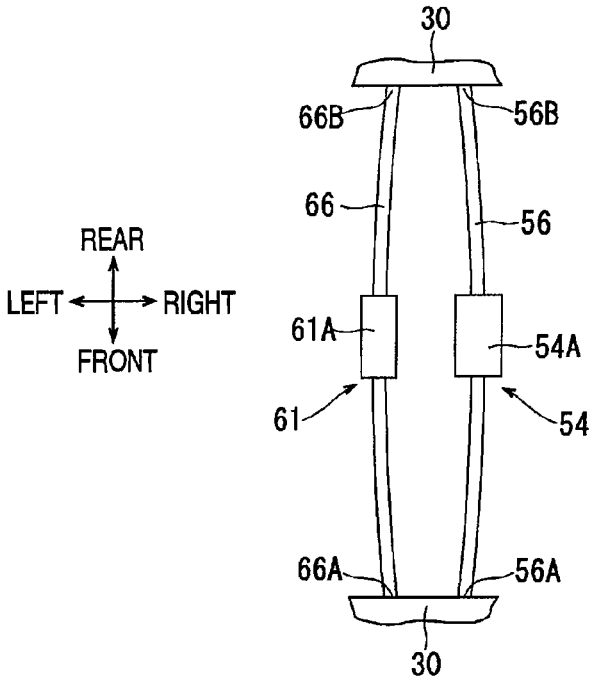
FIG. 13A illustrates bowed behaviors of the first and second shafts without the connector piece in the ADF according to the embodiment of the present invention.

When the reaction force, the friction force, and the tensile force affect the first and second shafts 56, 66, as shown in FIG. 13A, at least one of the first and second shafts 56, 66 without the connector pieces 100 is bowed in either the sheet-conveying direction or in an opposite direction from the sheet-conveying direction. FIG. 13A illustrates an example of the bowing behaviors of the first and second shafts 56, 66. A bowing range for the first shaft 56 and the second shaft 66 can be, for example, 1-2 millimeters.

With the bowing range, the separator 54A and the conveyer 61A fixed to the first shaft 56 and the second shaft 66 respectively may be displaced, and positional relation amongst the separator 54*a*, the conveyer 61A, and the sheet 9 may change. In the changed positional relation, the sheet 9 may be carried in a skewed or incorrect orientation with respect to the first feeding path 26.

Further, as shown in FIGS. 4-6, whilst the sheet 9 is carried sequentially in the first feeding path 26, the curved feeding path 27, and the second feeding path 28, relative positions of separator roller 54, the conveyer roller 62, the main roller 64, and the sheet 9 vary; therefore, the degrees of bowing for the first and second shafts 56, 66 fluctuate. In particular, the reactive force of the conveying force, the friction force in the separator pad 57, and the tensile force caused by the velocity difference may vary in the transitional positional relations, in which the sheet 9 is nipped with the separator roller 54 and the separator pad 57, in which the sheet 9 is nipped with the conveyer roller 61 and the pinch roller 65, and in which the sheet 9 is nipped with the main roller 64 and the pinch rollers 62, 63. Thus, the bowing behaviors of the first and the second shafts 56, 66 are not steady and may produce unstable speed to feed the sheet 9.

When the sheet 9 is carried in the skewed orientation and/or in unstable feeding speeds, the first and second image sensors 24, 25 may not read the images on the first and second surfaces 9A, 9B correctly, and errors in image reproduction may occur easily. In the present embodiment, points which define the above-mentioned transitional positional relations are referred to as significant points for image reading, and the errors in image reading tend to occur more frequently in the vicinities of the significant points.

Meanwhile, the ADF 11 in the present embodiment is provided with the connector pieces 100, which connect the first shaft 56 and the second shaft 66 to restrict the bowing behaviors of the first and second shafts 56, 66. As shown in FIG. 12, the connector piece 100 is formed to have a first ring portion 101, a second ring portion 102, a connector portion 103, and a guiding edge 104. The first ring portion 101 is an annular portion, through which the first shaft 56 penetrates. The second ring portion 102 is an annular portion, through which the second shaft 66 penetrates. The connector portion 103 is a plate to connect the first and the second ring portions 101, 102. The guiding edge 104 is formed at a lower side of the connector portion 103. In the present embodiment, the connector piece 100 is an injection-molded and integrally-formed piece of thermoplastic resin with higher slidability (e.g., polypropylene resin). However, a material and a forming method of the connector piece 100 are not limited. For example, the connector piece 100 may be an assembly of a plurality of separately formed parts. For another example, the connector piece 100 may have bearings (e.g., ball bearings) to hold the first and second shafts 56, 66.

Each of the first ring portion 101 and the second ring portion 102 is formed to have a shape of a short cylinder with a small axial length and a substantial radial thickness. The first ring portion 101 and the second ring portion 102 are formed to have an inner diameter, which is substantially (e.g., 0.05-0.2 millimeters) larger than an outer diameter of the first shaft 56 and the second shaft 66. Therefore, the first shaft 56 and the second shaft 66 are connected by the connector piece 100 and allowed to rotate within the inner diameters of the first ring portion 101 and the second ring portion 102 respectively and restricted from being rattled.

The connector portion 103 is an elongated plate, which extends along a plane perpendicular to rotation axes of the first and second shafts 56, 66 and connects the first ring portion 101 and the second ring portion 102 in a shortest distance.

Figure 14:
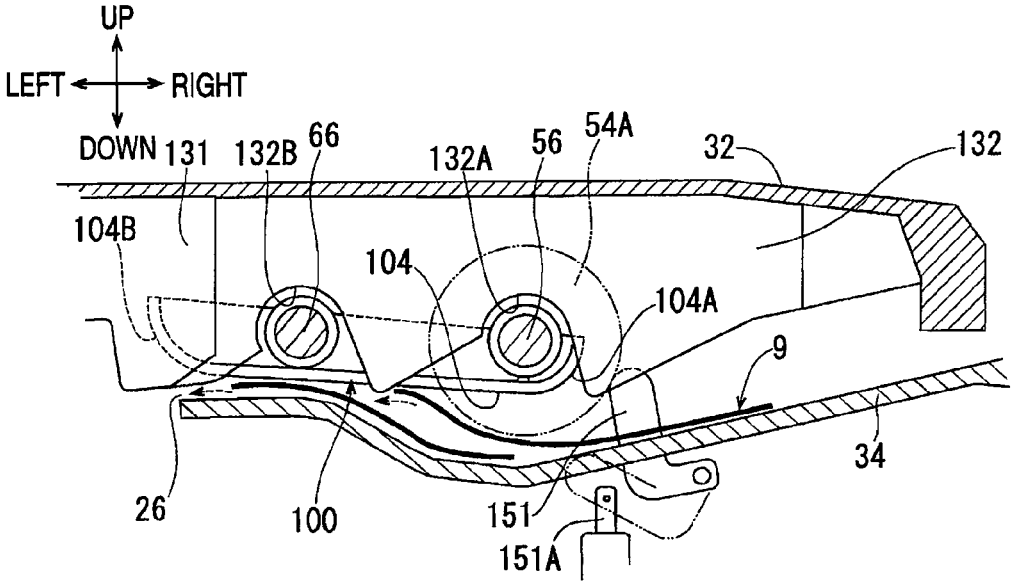
FIG. 14 is an enlarged cross-sectional view of the ADF according to the embodiment of the present invention taken from the line B-B in FIG. 2.

As shown in FIG. 14, which illustrates the connector piece 100 when viewed from a line B-B appearing in FIG. 2 in the axial direction of the first and the second shafts 56, 66, the connector piece 100 is formed to have the guiding edge 104 along the lower side thereof, which opposes the upper surface of the upper guide 34 across the first feeding path 26 when the connector piece 100 is installed in a correct position to hold the first and second shafts 56, 66. More specifically, the guiding edge 104 is a flat rim, of which cross section is similar to a shape of "T" together with a cross section of the connector portion 103. The guiding edge 104 extends substantially horizontally in the right-left direction above the upper guide 34. When the upper guide 34 is in the closed position, the guiding edge 104 is in a position lower than the cutouts 132A, 132B formed in the ribs 132 of the top cover 32. In other words, the guiding edge 104 extends along the first feeding path 26 and can be in contact with the first surface 9A of the sheet 9 being carried in the first feeding path 26.

Figure 15:
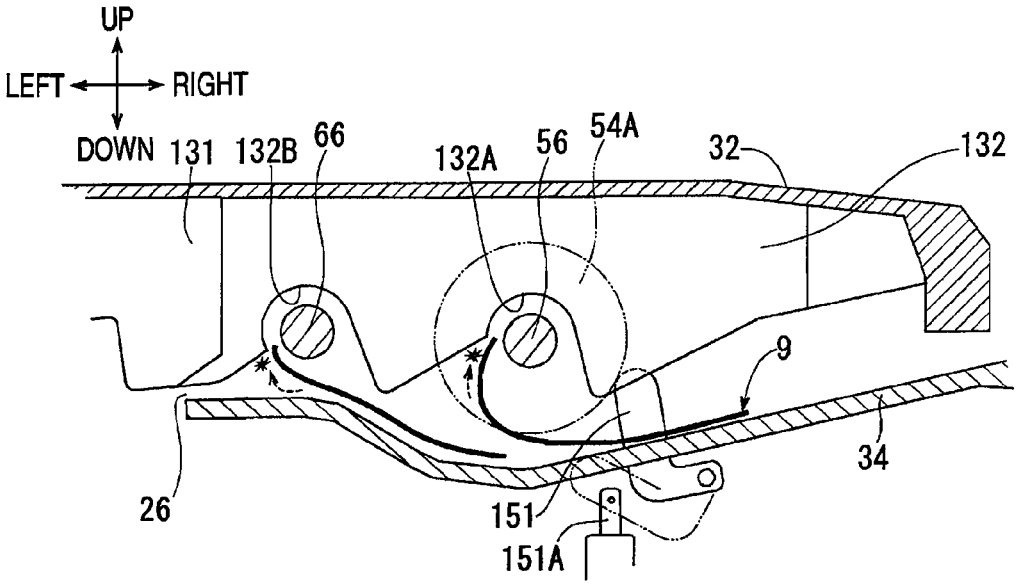
FIG. 15 is an enlarged cross-sectional view of the ADF without the connector piece according to the embodiment of the present invention taken from the line B-B in FIG. 2.

It is to be noted that, in the case where the ADF 11 lacks the connector pieces 100, as shown in FIG. 15, the front end of the sheet 9 traveling underneath the separator roller 54 may be turned upward to interfere with the cutouts 132A, 132B. The interfering sheet 9 may not be correctly carried further in the first feeding path 26 and may cause sheet jam. Meanwhile, in the present embodiment, the first feeding path 26 is smoothed by the guiding edges 104 of the connector pieces 100 (see FIG. 14). Accordingly, the front end of the sheet 9 is prevented from being interfered with the cutouts 132A, 132B, and the sheet 9 is securely carried in the first feeding path 26.

As shown in FIG. 14, a left-side end of the connector piece 100, which corresponds to the lower-stream side of the first feeding path 26, is formed to have a lower-stream side curved edge 104B. The curved edge 104B is formed continuously from the guiding edge 104 and curved to have an open end thereof directed upward (i.e., toward the upper side in FIG.

14) to be away from the first feeding path 26. The curved edge 104B horizontally laps over the ribs 131, 132. On the other hand, a right-side end of the connector piece 100, which corresponds to the upper-steam side of the first feeding path 26, is formed to have an upper-stream side curved edge 104A. The curved edge 104A is formed continuously from the guiding edge 104 and curved to have an open end thereof directed upward (i.e., toward the upper side in FIG. 14). The curved edge 104A horizontally laps over the separator 54A, which is indicated by a double-dotted line appearing in FIG. 14. It is to be noted that the separator 51A is closer to a viewer of FIG. 14 than the connector piece 100. In other words, the open end of the curved edge 104A does not extend further toward the upper-stream side than the circumference of the separator 54A.

In the sheet-feeding operation, although infrequently, sheet jam may occur in the first feeding path 26 on the downstream side with respect to the conveyer roller 61, and successive part of sheet 9 may slack to tangle around the conveyer roller 61. Accordingly, the sheet 9 may be pulled backward in the direction opposite from the sheet feeding direction by the conveyer roller 61. When the sheet 9 is pulled backward, due to the outline of the lower-stream side curved edge 104B, the sheet 9 being pulled backward is not caught by the connector piece 100 or not interfered with by the connector piece 100. Further, when the sheet 9 is correctly carried in the sheet feeding direction, and even when the sheet 9 becomes in contact with the curved edge 104B, the sheet 9 is not interfered with by the connector piece 100 but guided smoothly by the outline of the curved edge 104. Meanwhile, the outline of the upper-stream side curved edge 104A prevents the front end of the sheet 9, which is nipped with the separator roller 54, from being caught by the right-side end of the connector piece 100. Further, because the open end of the curved edge 104A does not extend further toward the upper-stream side than the circumference of the separator 54A, the separating behavior of the separator roller 54 is prevented from being interfered with by the curved edge 104A.

Figure 16:
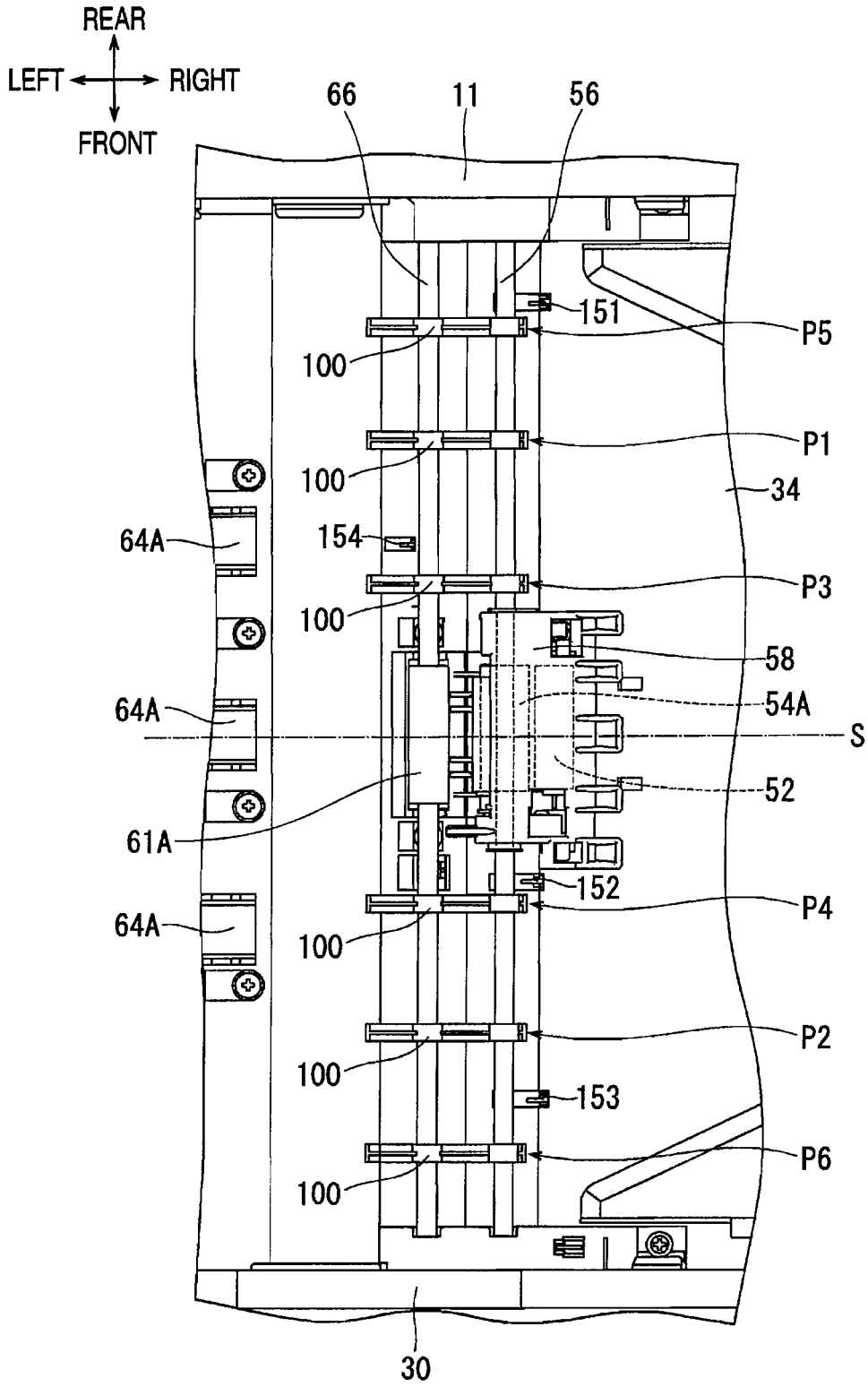
FIG. 16 is an enlarged top view of the ADF with the top cover removed according to the embodiment of the present invention.
Figure 17:
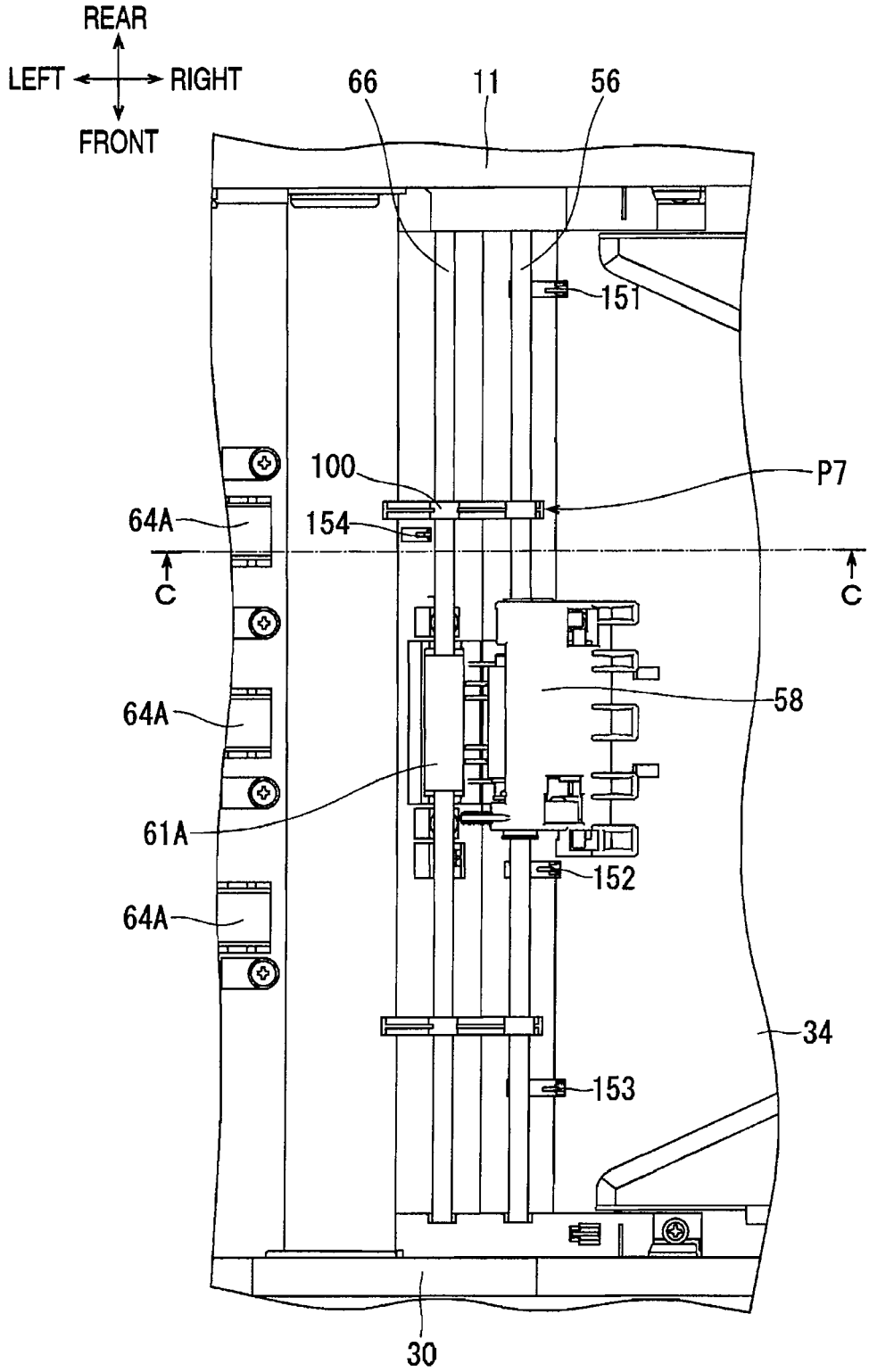
FIG. 17 is an enlarged top view of the ADF with the top cover removed according to the embodiment of the present invention.
Figure 18:
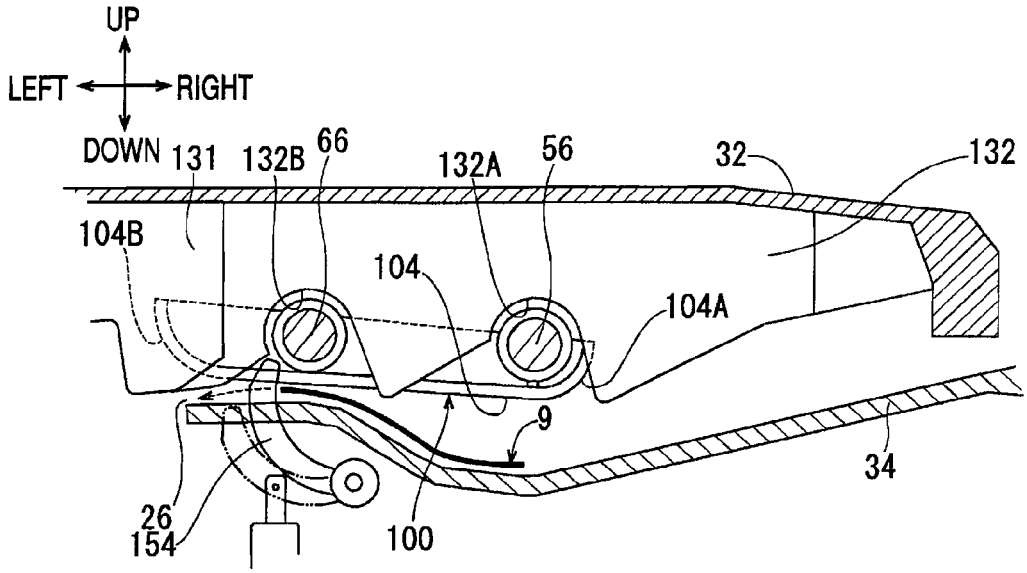
FIG. 18 is an enlarged cross-sectional view of the ADF according to the embodiment of the present invention taken from a line C-C in FIG. 17.
Figure 19:
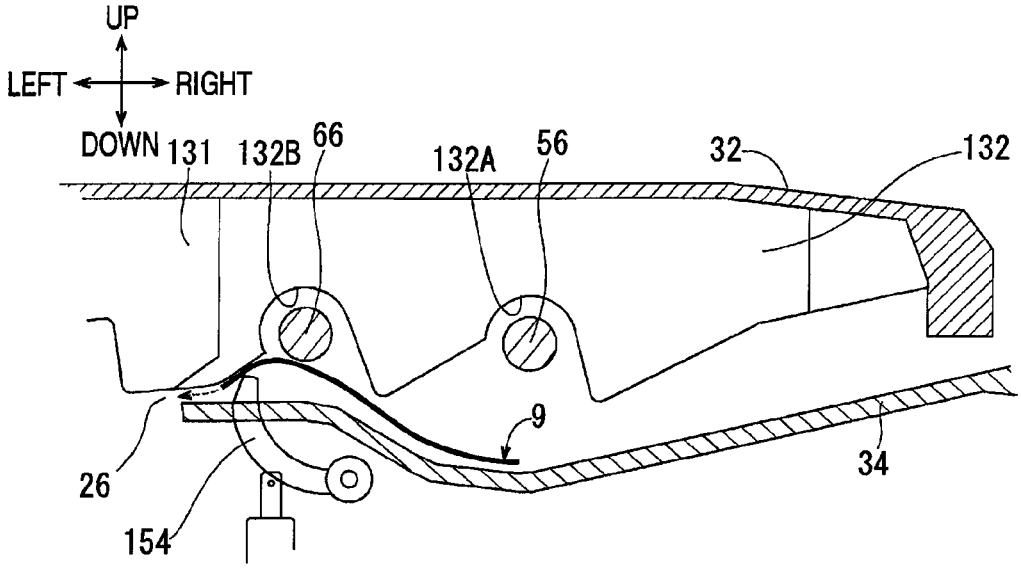
FIG. 19 is an enlarged cross-sectional view of the ADF taken from the line C-C in FIG. 17 but having no connector piece.

As shown in FIG. 16, the connector pieces 100 are arranged in parallel with the sheet feeding direction in symmetry positions P1, P2 with respect to a line S, which is a reference line connecting axial centers of the first shaft 56 and the second shaft P2.

5. Effectiveness

Figure 13B:
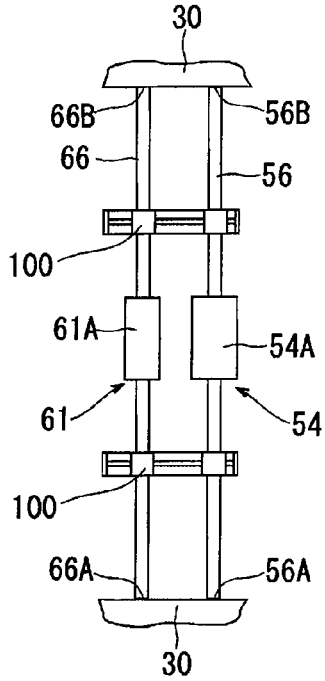
FIG. 13B illustrates restricted behaviors of the first and second shafts with the connector piece being attached in the ADF according to the embodiment of the present invention.

In the above ADF 11, the first shaft 56 and the second shaft 66 are connected by the connector pieces 100; therefore, the bowing behaviors of the first shaft 56 and the second shaft 66, which can be caused by the reaction force of the conveying force, the friction force in the separator pad 57, and the tensile force due to the difference of peripheral velocities, can be restricted. In other words, when the first shaft 56 tends to bow, the second shaft 66 supports the first shaft 56 via the connector pieces 100 and restricts the first shaft 56 from being deformed, and vice versa. On the other hand, without the connector pieces 100, as shown in FIG. 13A, the first shaft 56 and the second shaft 66 can be bowed. According to the present embodiment, as shown in FIG. 13B, the first shaft 56 and the second shaft 66 reinforce each other to prevent the bowing behaviors. Therefore, the skewed orientation of the sheet 9 being carried due to the deformation of the first shaft 56 and the second shaft 66 can be prevented, and the speed to convey the sheet 9 can be prevented from being fluctuated.

According to the present embodiment, the ADF 11 does not require the conventional arm-pieces hooking the first shaft 56 and the second shaft 66 to the main frame 30 or intermediate bearings to hold the first shaft 56 and the second shaft 66 at the lengthwise centers thereof. Therefore, a framework and assembly of the entire ADF 11 can be simplified, and a quantity of pieces of components in the ADF 11 can be reduced.

In other words, in the ADF 11 according to the present embodiment, errors (e.g., distortion and/or displacement of images) in the image reading operation conducted in cooperation with the first and second image sensors 24, 25 can be prevented from being caused. Further, due to the simplified configuration and reduction of the quantity of components, the inner space of the ADF 11 can be effectively arranged, and the entire ADF 11 can be downsized.

In the ADF 11 in the present embodiment, the first image sensor 24 is arranged along the first feeding path 26 on the lower-stream side with respect to the conveyer roller 61 and on the upper-stream side with respect to the main roller 64. Therefore, although the first image sensor 24 may be in a position to be affected by the significant points, the bowing behaviors of the first and second shafts 56, 66 are restricted, and image-reading errors can be reduced.

The ADF 11 in the present embodiment is provided with two connector pieces 100 in the symmetry positions P1, P2 with respect to the line S, which is the lengthwise centers of the first and second shafts 56, 66. Therefore, the connector pieces 100 can evenly restrict the lengthwise bowing behaviors of the first and second shafts 56, 66 so that the skewed orientation of the sheet 9 can be effectively prevented.

However, the ADF 11 may be provided with a single connector piece 100 instead of a pair of connector pieces 100. In such configuration (not shown), the single connector piece 100 can be arranged on the line S so that the connector piece 100 can evenly restrict the lengthwise bowing behaviors of the first and second shafts 56, 66. Further, each of the separator 54A and the conveyer 61A may be divided in two pieces so that the single connector piece 100 can be arranged in clearance between the two pieces of separators 54A and the conveyers 61A.

Alternatively, the ADF 11 may be provided with one or more pairs of connector pieces 100 in symmetry positions P3, P4 (see FIG. 16) with respect to the line S and in the vicinities of the axial ends of the separator 54A and the conveyer 61A, which are in the axial center of the separator roller 54 and the conveyer roller 61A. With the connector pieces 100 in the positions P3, P4, arranged closer to the axial center of the first and second shafts 56, 66, the first and second shafts 56, 66 are effectively restricted from being bowed and reinforced at the center portions thereof, which can be deformed in larger amounts than the other parts of the first and the second shafts 56, 66.

Additionally or alternatively, the ADF 11 may be provided with one or more pairs of connector pieces 100 in symmetry positions P5, P6 (see FIG. 16) with respect to the line S and in the vicinities of the axial ends of the first and second shafts 56, 66 to have the guiding edges 104 of the connector pieces 100 to be in contact with the sheet 9 at the vicinities of the widthwise ends thereof. With the connector pieces 100 in the positions P5, P6, the guiding edges 104 of the connector pieces 100 can suppress the widthwise ends of the sheet 9 downward. Thus, the widthwise ends of the sheet 9 can be prevented from being curled in the first feeding path 26, and sheet jam can be avoided.

Alternatively, the ADF 11 may be provided with at least one connector piece 100 in a position P7 (see FIG. 17), which is in adjacent to an outer or inner side of the sheet detector 154. With the connector piece 100 in the position P7, even when the sheet 9 tends to be uplifted by reaction force of the sheet detector 154, the connector piece 100 in adjacent to the detector piece 154 suppresses the sheet 9 downward and prevents the sheet 9 from floating away from the first feeding path 26 (see FIG. 18). Accordingly, the sheet detector 154 is pressed securely downward by the sheet 9 to be shifted in the lower position below the second surface 9B of the sheet 9 and detects the front end of the sheet 9 reaching the vicinity of the second shaft 66. Thus, errors in detecting the sheet 9 can be prevented. If the connector piece 100 is not in adjacent to the sheet detector 154, the sheet 9 may be uplifted due to the reaction force of the sheet detector 154 (see FIG. 19), and the sheet detector 154 remains in the upraised position to intersect the first feeding path 26. In such a case, the sheet 9 is not detected, and a detecting error occurs. Additionally, the connector pieces 100 may be arranged in positions adjacent to outer or inner sides of the sheet detectors 151-153 similarly to the sheet detector 154.

Figure 20:
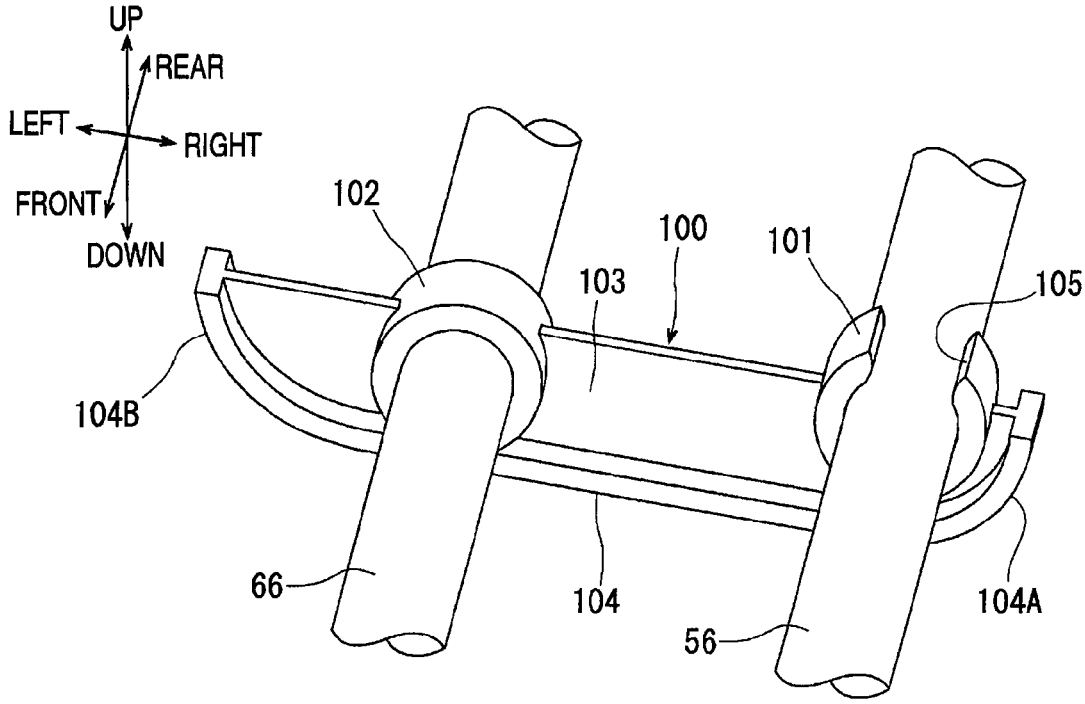
FIG. 20 is an enlarged perspective view of a modified connector piece in the ADF according to the embodiment of the present invention.

Alternatively, the connector piece 100 may be formed to have an opening 105 in the first ring portion 101 (see FIG. 20). With the opening 105, when the connector piece 100 is attached to the first shaft 56, the first shaft 56 may be inserted in the first ring portion 101 through the opening 105, which may be circumferentially widened when the first shaft 56 passes through. In this configuration, the connector piece 100 can be more easily attached to the first shaft 56. Additionally, the connector piece 100 may be formed to have an opening in the second ring portion 102.

Although an example of carrying out the invention has been described, those skilled in the art will appreciate that there are numerous variations and permutations of the sheet feeding device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the separator roller 54 and the conveyer roller 61 may not necessarily be adjacent to each other. More specifically, a third roller may be arranged in between the separator roller 54 and the conveyer roller 61. In such configuration, for example, the connector piece 100 to connect the separator roller 54 and the conveyer roller 61 may be formed to have an opening, through which a shaft of the third roller penetrates without interfering with the connector piece 100. For another example, the connector piece 100 may be formed to have a curved shape to avoid the third roller.

What is claimed is:

1. A sheet feeding device, comprising:

a sheet feeding mechanism to convey a sheet in a sheet feeding path; and an image processor to process an image formed on one of a first surface and a second surface of the sheet being conveyed in the sheet feeding path, wherein the sheet feeding mechanism includes a base structure, a first roller arranged in a position along the feeding path, and a second roller arranged in a position along the feeding path on a downstream side with respect to the first roller;

wherein the first roller includes a first shaft, which is rotatably supported by the base structure at each axial end thereof, and a first roller body fixed to the first shaft;

wherein the first roller is configured to feed the sheet to the sheet feeding path by rotating the first roller body in contact with the sheet along with the first shaft, and the second roller is configured to convey the sheet in the sheet feeding path by rotating the second roller body in contact with the sheet along with the second shaft;

wherein the first roller and the second roller are connected with each other by a connector member, which rotatably supports the first shaft and the second shaft and maintains positional relation of the first shaft and the second shaft with respect to each other;

wherein the sheet feeding mechanism includes a separator pad, which applies friction force to the second surface of the sheets in the sheet feeding path, in a position opposite from the first roller across the sheet feeding path; and wherein the connector member is formed to have a guiding edge, which extends along the sheet feeding path and is contactable with the first surface of the sheet, on a side facing the sheet feeding path when the connector member is assembled to hold the first shaft and the second shaft.

2. The sheet feeding device according to claim 1, wherein the image processor is arranged in a position along the sheet feeding path on a downstream side with respect to the second roller.

3. The sheet feeding device according to claim 1, wherein the image processor includes an image reader to read an image formed on the one of the first surface and the second surface of the sheet.

4. The sheet feeding device according to claim 1, further comprising:

a sheet-feed tray, in which a plurality of sheets are configured to be stacked, the sheet-feed tray being arranged on an upper-most side of the sheet feeding path;

wherein the first roller is a separator roller to separate a topmost sheet from the plurality of stacked sheets in the sheet-feed tray to feed the topmost sheet in the sheet feeding path;

wherein the second roller is a conveyer roller to apply conveying force to the topmost sheet separated by the first roller to convey the topmost sheet toward the downstream side in the sheet feeding path.

5. The sheet feeding device according to claim 4, wherein the sheet feeding mechanism includes a third roller in a position along the sheet feeding path on a downstream side with respect to the second roller;

wherein the third roller includes a third shaft, which is rotatably supported by the base structure at each axial end thereof, and a third roller body fixed to the third shaft;

wherein the third roller is configured to convey the sheet in the sheet feeding path by rotating the third roller body in contact with the sheet along with the third shaft; and wherein a peripheral velocity of the third roller is faster than a peripheral velocity of the second roller.

6. The sheet feeding device according to claim 5, wherein the image processor includes a first image processor, which is arranged in a position along the sheet feeding path on the downstream side with respect to the second roller and an upstream side with respect to the third roller, to process an image formed on the one of the first surface and the second surface of the sheet, and a second image processor, which is arranged in a position along the sheet feeding path on a downstream side with respect to the third roller, to process an image formed on the other of the first surface and the second surface of the sheet.

7. The sheet feeding device according to claim 1, wherein the sheet feeding mechanism includes a cover, which is shiftable between an open position and a closed position, to cover the first roller and the second roller when in the closed position;

wherein the cover is formed to have ribs to protrude toward the first shaft and the second shaft on an inner surface thereof when the cover is in the closed position;

wherein the connector member is formed to have a downstream-side curved edge, which is formed continuously from the guiding edge and curved to have an open end thereof directed to be away from the sheet feeding path, wherein the connector member horizontally laps over the ribs at a downstream portion thereof including the open end of the downstream-side curved edge when the cover is in the closed position.

8. The sheet feeding device according to claim 1, wherein the connector member is formed to have an upstream-side curved edge, which is formed continuously from the guiding edge and curved to have an open end thereof directed to be away from the sheet feeding path;

wherein the connector member horizontally laps over the first roller body at an upstream portion thereof including the open end of the upstream-side curved edge.

9. The sheet feeding device according to claim 1, wherein the connector member is arranged in a position with reference to a line, which connects axial centers of the first shaft and the second shaft.

10. The sheet feeding device according to claim 9, wherein the connector member is arranged on the line.

11. The sheet feeding device according to claim 9, wherein the connector member is arranged in each side of the line in symmetry positions with respect to the line.

12. The sheet feeding device according to claim 11, wherein the connector member is arranged in vicinities of axial ends of the first roller body and the second roller body, which are arranged in the axial centers of the first shaft and the second shaft.

13. The sheet feeding device according to claim 11, wherein the connector member is formed to have a guiding edge, which extends along the sheet feeding path and is contactable with the first surface of the sheet, on a side facing the sheet feeding path when the connector member is assembled to hold the first shaft and the second shaft; and wherein the connector member is arranged in a position to have the guiding edge to be in contact with a widthwise-end portion of the first surface of the sheet.

14. The sheet feeding device according to claim 1, wherein the sheet feeding mechanism further includes a sheet detector, which is arranged in the vicinity of one of the first roller and the second roller, to detect the sheet in the sheet feeding path reaching the vicinity of the one of the first roller and the second roller;

wherein the connector member is arranged adjacent to one of an outer side and an inner side of the sheet detector.

15. The sheet feeding device according to claim 14, wherein the sheet detector intersects the sheet feeding path when the sheet detector is cleared from the sheet;

wherein the sheet detector is displaced out of the sheet feeding path when the sheet detector is in contact with the sheet being conveyed; and wherein the sheet reaching the vicinity of the one of the first roller and the second roller is detected by the displacement of the sheet detector.

16. The sheet feeding device according to claim 1, wherein the connector member includes:

a first ring portion, through which the first shaft of the first roller rotatably penetrates;

a second ring portion, through which the second shaft of the second shaft rotatably penetrates;

a connector portion, which extends in parallel with the sheet feeding path and connects the first ring portion and the second ring portion; and a guiding edge, which is formed on a side facing the sheet feeding path when the connector member is assembled to hold the first shaft and the second shaft and extends along the sheet feeding path to be contactable with the first surface of the sheet being conveyed.

* * * * *